US011790721B2

(12) United States Patent
Ihara

(10) Patent No.: US 11,790,721 B2
(45) Date of Patent: Oct. 17, 2023

(54) SHEET PROCESSING APPARATUS

(71) Applicant: Glory Ltd., Himeji (JP)

(72) Inventor: Wataru Ihara, Hyogo (JP)

(73) Assignee: GLORY LTD., Himeji (JP)

( * ) Notice: Subject to any disclaimer, the term of this patent is extended or adjusted under 35 U.S.C. 154(b) by 54 days.

(21) Appl. No.: 17/378,793

(22) Filed: Jul. 19, 2021

(65) Prior Publication Data

US 2022/0028203 A1 Jan. 27, 2022

(30) Foreign Application Priority Data

Jul. 22, 2020 (JP) ..... 2020-125457

(51) Int. Cl.

| | |
|---|---|
| ***G07D 11/23*** | (2019.01) |
| ***G07D 11/50*** | (2019.01) |
| ***G07D 11/17*** | (2019.01) |
| ***G07D 11/235*** | (2019.01) |

(52) U.S. Cl.

CPC ..... *G07D 11/23* (2019.01); *G07D 11/17* (2019.01); *G07D 11/235* (2019.01); *G07D 11/50* (2019.01)

(58) Field of Classification Search

CPC ..... G07D 11/23; G07D 11/17; G07D 11/235; G07D 11/50; G07D 11/24; G07D 11/03; G07D 11/34

See application file for complete search history.

(56) References Cited

U.S. PATENT DOCUMENTS

| | | | | |
|---|---|---|---|---|
| 2012/0024659 | A1* | 2/2012 | Mizoro | G07D 11/50 194/353 |
| 2013/0001039 | A1* | 1/2013 | Mizushima | G07D 11/30 194/206 |
| 2016/0335825 | A1* | 11/2016 | Nishino | G07D 11/10 |
| 2017/0278358 | A1 | 9/2017 | Ino et al. | |
| 2018/0330563 | A1* | 11/2018 | Yuasa | G07F 19/20 |
| 2021/0335364 | A1 | 10/2021 | Shirai | |
| 2022/0116270 | A1 | 4/2022 | Matsumura | |

FOREIGN PATENT DOCUMENTS

| | | | |
|---|---|---|---|
| JP | 2013-16133 A | | 1/2013 |
| JP | 2013016133 A | * | 1/2013 |
| JP | 6695651 B2 | | 5/2020 |

OTHER PUBLICATIONS

Extended European search report dated Jan. 4, 2022, in corresponding European patent Application No. 21186650.4, 9 pages.

* cited by examiner

*Primary Examiner* — Sonji N Johnson
(74) *Attorney, Agent, or Firm* — XSENSUS LLP

(57) ABSTRACT

A sheet processing apparatus includes a first storage and a second storage that each stores a sheet; a transport that transports the sheet; a recognition circuit that performs a first recognition processing to recognize the sheet; an outlet that discharges the sheet in a case that the sheet is recognized as normal in the first recognition processing; a temporary storage that stores the sheet in a case that the sheet is recognized as abnormal in the first recognition processing; and processing circuitry that controls the transport and the recognition circuit such that storage control processing is performed, the storage control processing being processing in which the sheet stored in the temporary storage is transported to the first storage unit or to the second storage.

12 Claims, 13 Drawing Sheets

141

143 144

142

| STORAGE ORDER | ABNORMALITY FACTOR |
|---|---|
| 10 | FITNESS ABNORMALITY |
| 9 | SERIAL NUMBER-UNREADABLE |
| 8 | DENOMINATION ABNORMALITY |
| 7 | FITNESS ABNORMALITY |
| 6 | SERIAL NUMBER-UNREADABLE |
| 5 | SERIAL NUMBER-UNREADABLE |
| 4 | TRANSPORT ABNORMALITY |
| 3 | FITNESS ABNORMALITY |
| 2 | SERIAL NUMBER-UNREADABLE |
| 1 | SERIAL NUMBER-UNREADABLE |

FIG. 3

141A

142A

| 143 STORAGE ORDER | 145A FEEDING SOURCH | 144 ABNORMALITY FACTOR |
|---|---|---|
| 10 | FIRST RECYCLING STORAGE APPARATUS | FITNESS ABNORMALITY |
| 9 | FIRST RECYCLING STORAGE APPARATUS | SERIAL NUMBER-UNREADABLE |
| 8 | SECOND RECYCLING STORAGE APPARATUS | DENOMINATION ABNORMALITY |
| 7 | FIRST RECYCLING STORAGE APPARATUS | FITNESS ABNORMALITY |
| 6 | SECOND RECYCLING STORAGE APPARATUS | SERIAL NUMBER-UNREADABLE |
| 5 | SECOND RECYCLING STORAGE APPARATUS | SERIAL NUMBER-UNREADABLE |
| 4 | FIRST RECYCLING STORAGE APPARATUS | TRANSPORT ABNORMALITY |
| 3 | SECOND RECYCLING STORAGE APPARATUS | FITNESS ABNORMALITY |
| 2 | FIRST RECYCLING STORAGE APPARATUS | SERIAL NUMBER-UNREADABLE |
| 1 | FIRST RECYCLING STORAGE APPARATUS | SERIAL NUMBER-UNREADABLE |

FIG. 6

241B 243B 244B

242B

| STORAGE ORDER | SERIAL NUMBER |
|---|---|
| 6 | A123456 |
| 5 | A789012 |
| 4 | A111111 |
| 3 | B123456 |
| 2 | C789012 |
| 1 | D111111 |

FIG. 8

SHEET PROCESSING APPARATUS

CROSS-REFERENCE TO RELATED APPLICATION

This application claims priority to Japanese Patent Application No. 2020-125457, filed on Jul. 22, 2020, the disclosure of which is incorporated herein by reference in its entirety.

TECHNICAL FIELD

The present disclosure relates to a sheet processing apparatus and a sheet processing method.

BACKGROUND

In the related art, there is known a banknote processing apparatus that dispenses a banknote stored in a storage unit. In the banknote processing apparatus in the related art, a recognition unit recognizes a banknote transported from a banknote cassette when a banknote is dispensed. In the banknote processing apparatus, a customer unit stacks banknotes whose recognition result is normal, and a temporary storage unit stacks banknotes whose recognition result is abnormal.

In the banknote processing apparatus, when banknotes in a dispensing amount are stacked in the customer unit, the recognition unit re-recognizes the banknotes stacked in the temporary storage unit. In the banknote processing apparatus, banknotes whose re-recognition result is normal are stacked in banknote cassettes in accordance with denominations of the banknotes, and banknotes whose re-recognition result is abnormal are stacked in a reject cassette.

SUMMARY

A sheet processing apparatus in accordance with the present disclosure includes a first storage and a second storage that each stores a sheet; a transport that transports the sheet; a recognition circuit that performs a first recognition processing to recognize the sheet; an outlet that discharges the sheet in a case that the sheet is recognized as normal in the first recognition processing; a temporary storage that stores the sheet in a case that the sheet is recognized as abnormal in the first recognition processing; and processing circuitry that controls the transport and the recognition circuit such that storage control processing is performed, the storage control processing being processing in which the sheet stored in the temporary storage is transported to the first storage unit or to the second storage. The storage control processing comprises first processing in which, in a case where a predetermined condition is satisfied, the sheet stored in the temporary storage is transported to the second storage; and second processing in which, in a case where the predetermined condition is not satisfied, the recognition circuit performs a second recognition processing on the sheet stored in the temporary storage, the sheet recognized as normal is transported to the first storage, and the sheet recognized as abnormal is transported to the second storage.

BRIEF DESCRIPTION OF THE DRAWINGS

FIG. 3 is a schematic diagram illustrating a configuration of an abnormal note list according to the present disclosure;

FIG. 6 is a schematic diagram illustrating a configuration of an abnormal note list according to the present disclosure;

FIG. 8 is a schematic diagram illustrating a configuration of a serial number list according to the present disclosure;

DETAILED DESCRIPTION OF THE DRAWINGS

Figure 1:
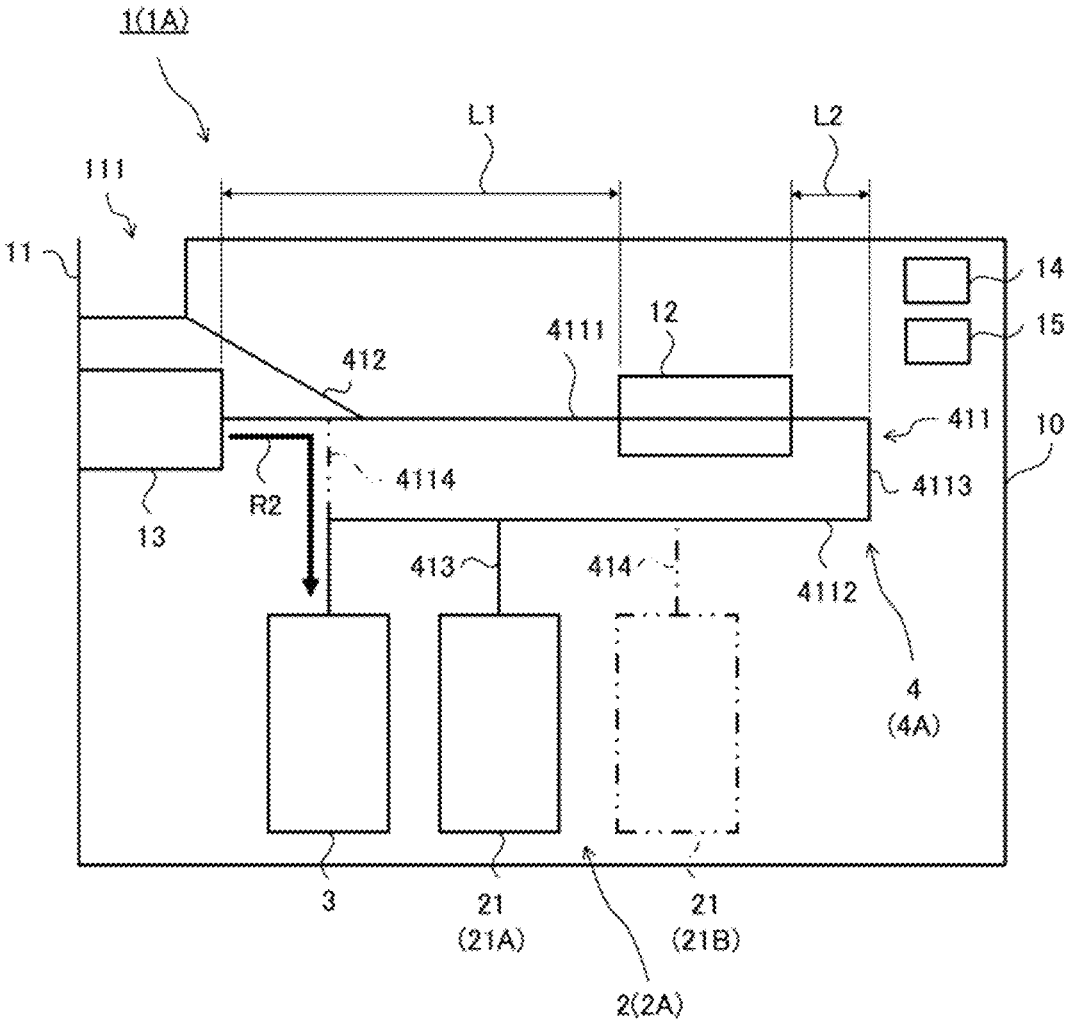
FIG. 1 is a schematic diagram illustrating an overview of an internal configuration of a banknote processing apparatus according to the present disclosure.

Recognition results may be unstable depending on the characteristics of banknotes. For example, a banknote recognized as normal at a time of re-recognition is recognized as a banknote as a dispensing object by a recognition unit at a time of the next or subsequent dispensing, but may be recognized as abnormal again by the recognition unit when the banknote is recognized at the time of the next or subsequent dispensing. In this case, the dispensing efficiency decreases.

An object of the present disclosure is to provide an sheet processing apparatus and a sheet processing method that are capable of suppressing a decrease in the discharging efficiency of a normal sheet.

To achieve the above-described object, a sheet processing apparatus of the present disclosure comprises: a first storage unit and a second storage unit; a transport unit; a recognition unit; an outlet section; a temporary storage unit; and a control unit. Each of the first storage unit and the second storage unit stores a sheet. The transport unit transports the sheet. The recognition unit recognizes the sheet. The outlet section discharges the sheet recognized as normal in first recognition processing that is performed by the recognition unit on the sheet stored in the first storage unit. The temporary storage unit stores the sheet recognized as abnormal in the first recognition processing. The control unit controls the transport unit and the recognition unit such that storage control processing is performed. The storage control processing is processing in which the sheet stored in the temporary storage unit is transported to the first storage unit or the second storage unit. The storage control processing comprises: first processing in which, in a case where a predetermined condition is satisfied, the sheet stored in the temporary storage unit is transported to the second storage unit; and second processing in which, in a case where the predetermined condition is not satisfied, the recognition unit performs second recognition processing on the sheet stored in the temporary storage unit, the sheet recognized as normal is transported to the first storage unit, and the sheet recognized as abnormal is transported to the second storage unit.

Another sheet processing apparatus of the present disclosure comprises: a first storage unit and a second storage unit; a transport unit; a recognition unit; an outlet section; and a control unit. Each of the first storage unit and the second storage unit stores a sheet. The transport unit transports the sheet. The recognition unit recognizes the sheet. The outlet section discharges the sheet. The control unit controls the transport unit and the recognition unit such that: the sheet stored in the first storage unit is transported to the recognition unit; the recognition unit performs first recognition processing on the sheet that has been transported; the sheet recognized as normal in the first recognition processing is transported to the outlet section; and in a case where a factor in causing the sheet to be recognized as abnormal in the first recognition processing is a serial number-related abnormality in which a serial number attached to the sheet is abnormal, the sheet recognized as abnormal is transported to the second storage unit.

Yet another sheet processing apparatus of the present disclosure comprises: a first storage unit and a second storage unit; a transport unit; a recognition unit; an outlet section; and a control unit. Each of the first storage unit and the second storage unit stores a sheet. The transport unit transports the sheet. The recognition unit recognizes the sheet. The outlet section discharges the sheet. The control unit controls the transport unit and the recognition unit such that: the sheet stored in the first storage unit is transported to the recognition unit; the recognition unit performs first recognition processing on the sheet that has been transported; the sheet recognized as normal in the first recognition processing is transported to the outlet section; and in a case where the sheet is recognized as abnormal in the first recognition processing and a number of sheets stored in the first storage unit satisfies a predetermined condition, the sheet recognized as abnormal is transported to the second storage unit.

A sheet processing method of the present disclosure uses a sheet processing apparatus comprising: a first storage unit and a second storage unit; a recognition unit; an outlet section; and a temporary storage unit. Each of the first storage unit and the second storage unit stores a sheet. The recognition unit recognizes the sheet. The outlet section discharges the sheet recognized as normal in first recognition processing that is performed by the recognition unit on the sheet stored in the first storage unit. The temporary storage unit stores the sheet recognized as abnormal in the first recognition processing. The sheet processing method comprises: performing, in a case where a predetermined condition is satisfied, first processing in which the sheet stored in the temporary storage unit is transported to the second storage unit; and performing, in a case where the predetermined condition is not satisfied, second processing in which the recognition unit performs second recognition processing on the sheet stored in the temporary storage unit, the sheet recognized as normal is transported to the first storage unit, and the sheet recognized as abnormal is transported to the second storage unit.

Another sheet processing method of the present disclosure uses a sheet processing apparatus comprising: a first storage unit and a second storage unit; a recognition unit; and an outlet section. Each of the first storage unit and the second storage unit stores a sheet. The recognition unit recognizes the sheet. The outlet section discharges the sheet. The sheet processing method comprises: transporting the sheet stored in the first storage unit to the recognition unit; performing, by the recognition unit, first recognition processing on the sheet that has been transported; transporting the sheet recognized as normal in the first recognition processing to the outlet section; and transporting, in a case where a factor in causing the sheet to be recognized as abnormal in the first recognition processing is an abnormality of a serial number attached to the sheet, the sheet recognized as abnormal to the second storage unit.

Yet another sheet processing method of the present disclosure uses a sheet processing apparatus comprising: a first storage unit and a second storage unit; a recognition unit; and an outlet section. Each of the first storage unit and the second storage unit stores a sheet. The recognition unit recognizes the sheet. The outlet section discharges the sheet. The sheet processing method comprises: transporting the sheet stored in the first storage unit to the recognition unit; performing, by the recognition unit, first recognition processing on the sheet that has been transported; transporting the sheet recognized as normal in the first recognition processing to the outlet section; and transporting, in a case where the sheet is recognized as abnormal in the first recognition processing and a number of sheets stored in the first storage unit satisfies a predetermined condition, the sheet recognized as abnormal to the second storage unit.

According to the sheet processing apparatus and the sheet processing method of the present disclosure, it is possible to suppress a decrease in the discharging efficiency of a normal sheet.

EMBODIMENTS

The present disclosure is implemented in discharging processing of a sheet processing apparatus. The discharging processing is processing in which a sheet stored in a storage unit of the sheet processing apparatus is discharged from an outlet section. The outlet section is, for example, a dispensing unit. The storage unit is, for example, a recycling storage apparatus. In the discharging processing, a sheet fed out from the storage unit is transported to a recognition unit by a transport unit and is recognized by the recognition unit. A normal note is discharged from the outlet section. An abnormal note is stored in a temporary storage unit. The discharging processing is, for example, dispensing processing. Further, the discharging processing may be collection processing. The collection processing is processing which is performed by a manager who manages the sheet processing apparatus, and in which a sheet in the storage unit is discharged from the outlet section and is collected outside the sheet processing apparatus.

Hereinafter, embodiments of the present disclosure will be described with reference to the accompanying drawings.

In the embodiments described below, a description will be given mainly of a case where the discharging processing is dispensing processing, but the dispensing processing can be replaced with collection processing.

Embodiment 1

(Configuration of Banknote Processing Apparatus)

First, a configuration of a banknote processing apparatus in Embodiment 1 of the present disclosure will be described. FIG. 1 is a block diagram illustrating an overview of an internal configuration of the banknote processing apparatus.

Figure 2A:
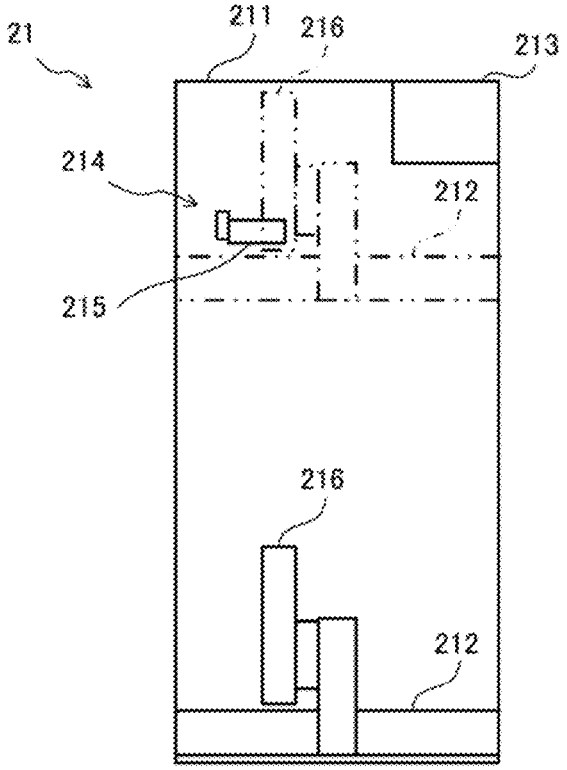
FIG. 2A is a schematic diagram illustrating an overview of an internal configuration of a recycling storage apparatus according to the present disclosure.
Figure 2B:
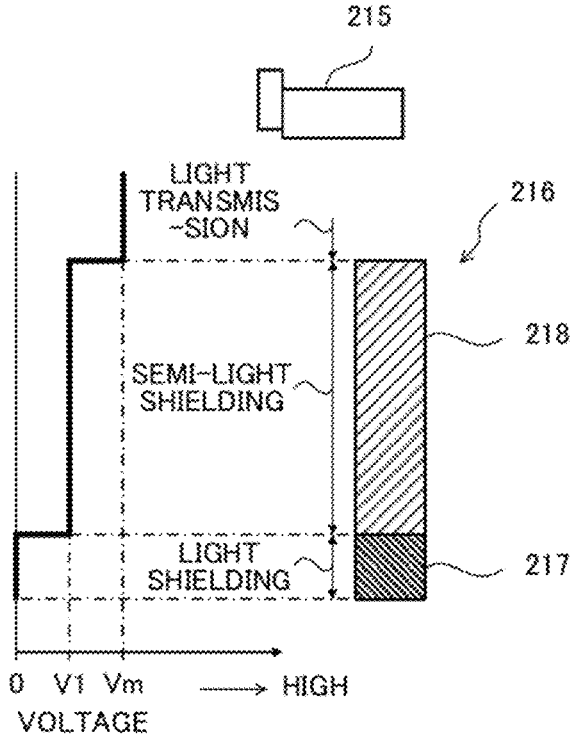
FIG. 2B is a schematic diagram illustrating an overview configuration of a sensor that forms the recycling storage apparatus.

FIG. 2A is a schematic diagram illustrating an overview of an internal configuration of a recycling storage apparatus. FIG. 2B is a schematic diagram illustrating an overview configuration of a sensor that forms the recycling storage apparatus. FIG. 3 is a schematic diagram illustrating a configuration of an abnormal note list. The arrangements of the respective configurations of the banknote processing apparatus or the like may be described with the direction indicated in FIG. 1.

A banknote processing apparatus 1 indicated in FIG. 1 is an example of the sheet processing apparatus. The banknote processing apparatus 1 is installed, for example, in a lobby of a financial institution such as a bank or at a customer service counter thereof. Note that, the banknote processing apparatus 1 may be installed at a settlement counter of a store such as a retail store or in a back office thereof. The banknote processing apparatus 1 dispenses a banknote in accordance with its setting. The banknote is an example of the sheet. The banknote processing apparatus 1 comprises a housing 10.

The banknote processing apparatus 1 further comprises: a dispensing unit 11; a recognition unit 12; a first storage unit 2; a second storage unit 3; a temporary storage unit 13; a transport unit 4; and a control unit 15. The transport unit 4 connects the dispensing unit 11, the recognition unit 12, the first storage unit 2, the second storage unit 3, and the temporary storage unit 13, and transports a banknote. The recognition unit 12 may be provided on the transport unit 4. The control unit 15 may be provided outside the housing 10. In an exemplary implementation, control unit 15 comprises processing circuitry, which will be discussed in detailed later with respect to FIG. 13. The banknote processing apparatus 1 may comprise an operation unit and a memory unit 14 when needed. Further, the banknote processing apparatus 1 may comprise an interface for connecting an external operation unit and/or an external memory unit.

The dispensing unit 11 is an example of the outlet section. The dispensing unit 11 dispenses (discharges) a banknote recognized as normal in first recognition processing that is performed by the recognition unit 12 on a banknote stored in the first storage unit 2. The dispensing unit 11 comprises an outlet 111. The outlet 111 is provided so as to open upward in a front portion of the housing 10. The dispensing unit 11 is configured so as to stack a plurality of banknotes in an overlapping state. Note that, a shutter that closes the outlet 111 may also be provided.

The recognition unit 12 includes circuitry and generates signals indicating the denomination and authenticity of a banknote transported by the transport unit 4. These signals are transmitted to the control unit 15. The recognition unit 12 can also generate signals for detecting the fitness, attitude, and size of a banknote during transport and a space between banknotes during transport, and can transmit the signals to the control unit 15.

The first storage unit 2 is configured so as to store a banknote as a dispensing object. The first storage unit 2 may be one recycling storage apparatus 21 as indicated by a solid line or may be a plurality of recycling storage apparatuses 21. The recycling storage apparatus 21 is formed of a stack-type storing unit that stores banknotes in an overlapping manner. The recycling storage apparatus 21 takes in and stores banknotes one by one, and feeds out the stored banknotes one by one. The denominations of banknotes to be stored in the recycling storage apparatus 21 are set in advance. Note that, the recycling storage apparatus 21 may also be formed of a tape-type storing unit that uses a strip-shaped tape attached to the outer peripheral surface of a drum to wind a banknote on the drum together with the tape. Further, the first storage unit 2 (the recycling storage apparatus 21) may also be configured such that the first storage unit 2 can be set in the housing 10 and can be taken out from the housing 10, by opening a door provided in the housing 10.

The banknote processing apparatus 1 may manage a number of banknotes stored in the first storage unit 2. Further, the banknote processing apparatus 1 may manage a storage state of banknotes stored in the first storage unit 2. For example, as the storage state, it is possible to exemplify an approximate number of stored banknotes (although not an exact number of banknotes), a storage ratio (a ratio of a number of stored banknotes to a number of banknotes that can be stored), or the like, but the storage state is not limited thereto. The first storage unit 2 may comprise an apparatus that determines a storage state of banknotes stored inside the first storage unit 2. Here, an example of a specific configuration of the recycling storage apparatus 21 will be described. As illustrated in FIG. 2A, the recycling storage apparatus 21 comprises a storage housing 211, a stage 212, a storage-transport mechanism 213, and a detection unit 214.

The stage 212 is configured so as to be capable of storing banknotes in an overlapping state. The stage 212 is configured to be vertically movable inside the storage housing 211 in accordance with an amount of banknotes to be stored. The stage 212 is provided so as to be located downward as the amount of banknotes to be stored is larger and so as to be located upward as the amount of banknotes to be stored is fewer. With such a configuration, the position of the topmost banknote on the stage 212 is constant or almost constant regardless of the amount of stored banknotes.

The storage-transport mechanism 213 is provided, for example, on an upper portion of the storage housing 211. The storage-transport mechanism 213 places a banknote transported by the transport unit 4 on the stage 212. The storage-transport mechanism 213 sends out the topmost banknote on the stage 212 to the transport unit 4.

The detection unit 214 detects that a banknote storage state in the recycling storage apparatus 21 has become "near empty" or "empty". The "near empty" refers to a state in which an amount of banknotes is reduced, and the "empty" refers to a state in which an amount of banknotes is extremely reduced or 0. The detection unit 214 comprises a sensor 215 and a detection plate 216.

The sensor 215 is formed of, for example, a transmission-type optical sensor. The sensor 215 is fixed above the center of the storage housing 211, for example. The sensor 215 comprises a light emission unit and a light reception unit. The sensor 215 emits a detection light from the light emission unit toward the light reception unit, and outputs a voltage signal in accordance with a light reception intensity at the light reception unit to the control unit 15. The voltage signal becomes larger as the light reception intensity is higher.

The detection plate 216 is fixed to the stage 212. The detection plate 216 is formed to have a vertically extending shape. As illustrated in FIG. 2B, the detection plate 216 comprises a light shielding unit 217 located at the lower end, and a semi-light shielding unit 218 formed of the part other than the light shielding unit 217. The height of the light shielding unit 217 (the distance in the vertical direction) is lower than the height of the semi-light shielding unit 218. The light shielding unit 217 is configured so as to have a light shielding ratio of the detection light of the sensor 215 of 100% or almost 100%. The semi-light shielding unit 218 is configured so as to have a light shielding ratio of the detection light lower than that of the light shielding unit 217 and exceeding 0%.

In a case where the recycling storage apparatus 21 stores a certain amount of banknotes and, as indicated by a solid line in FIG. 2A, the stage 212 is located in a lower portion of the storage housing 211, the detection plate 216 is not located on the light axis of the detection light of the sensor 215. Accordingly, as illustrated in FIG. 2B, the magnitude of a voltage signal outputted from the sensor 215 becomes a maximum value Vm. While the voltage signal having a magnitude of Vm is being acquired, the control unit 15 determines that the banknote storage state in the recycling storage apparatus 21 is neither "near empty" nor "empty".

When the stage 212 is raised and the semi-light shielding unit 218 of the detection plate 216 is located on the light axis of the detection light of the sensor 215 as a number of banknotes stored in the recycling storage apparatus 21 decreases, the magnitude of a voltage signal outputted from the sensor 215 becomes V1 smaller than the maximum value Vm and larger than 0. While the voltage signal having a magnitude of V1 is being acquired, the control unit 15 determines that the number of banknotes stored in the recycling storage apparatus 21 is "near empty".

When the stage 212 is further raised and the light shielding unit 217 of the detection plate 216 is located on the light axis of the detection light of the sensor 215 as the number of banknotes stored in the recycling storage apparatus 21 further decreases, the magnitude of a voltage signal outputted from the sensor 215 becomes 0 or almost 0. While the voltage signal having a magnitude of 0 or almost 0 is being acquired, the control unit 15 determines that the number of banknotes stored in the recycling storage apparatus 21 is "empty". Even in a case where the recycling storage apparatus 21 is formed of a tape-type storage unit, the recycling storage apparatus 21 may comprise an apparatus that determines a storage state of banknotes stored inside the recycling storage apparatus 21. For example, the storage state may be determined by detecting the states of banknotes wound on a drum and of a tape. Further, the storage state may also be determined based on the drum diameter, the rotation amount of the drum, the diameter of a reel, the rotation amount of the reel or the movement amount of the tape.

The second storage unit 3 is configured to store a banknote which the control unit 15 determines cannot be dispensed based on a signal from the recognition unit 12. The second storage unit 3 is formed of a stack-type or tape-type storage unit. Further, the second storage unit 3 may also be configured such that the second storage unit 3 can be set in the housing 10 and can be taken out from the housing 10, by opening a door provided in the housing 10.

The temporary storage unit 13 temporarily stores a banknote when the discharging processing is performed. The temporary storage unit 13 is formed of a stack-type or tape-type storage unit.

The transport unit 4 comprises a first transport path 411, a second transport path 412, and a third transport path 413.

The first transport path 411 connects the temporary storage unit 13 and the second storage unit 3. The first transport path 411 comprises an upper-side path 4111 extending longitudinally (a first direction), a lower-side path 4112 extending longitudinally below the upper-side path 4111, and a rear reversing path 4113 extending vertically (a second direction) on the rear side to connect the upper-side path 4111 and the lower-side path 4112. Here, the front side is a side on which the dispensing unit 11 of the banknote processing apparatus 1 is provided (the left side in FIG. 1).

The temporary storage unit 13 is connected to the front end of the upper-side path 4111. The upper-side path 4111 is provided with the recognition unit 12. The recognition unit 12 is provided at any position. However, the recognition unit 12 may be provided, as an example, at a position at which a distance L1 of a part (a straight part) of the upper-side path 4111, where the part extends in the horizontal direction from the front end of the recognition unit 12 to the temporary storage unit 13, is longer than a distance L2 of a part (a straight part) of the upper-side path 4111, where the part extends in the horizontal direction from the rear end of the recognition unit 12 to the rear reversing path 4113. Thus, both the distance from the front end of the recognition unit 12 to the temporary storage unit 13 and the distance from the rear end of the recognition unit 12 to the first storage unit 2 can be sufficiently large. The second storage unit 3 is connected to the front end of the lower-side path 4112.

The second transport path 412 connects the dispensing unit 11 and a position of the upper-side path 4111, where the position is on the front side of the recognition unit 12. A connection part between the second transport path 412 and the upper-side path 4111 is provided with a first diverter mechanism.

The third transport path 413 connects the recycling storage apparatus 21 and a position of the lower-side path 4112, where the position is on the rear side of a connection part between the lower-side path 4112 and the temporary storage unit 13. A connection part between the third transport path 413 and the lower-side path 4112 is provided with a second diverter mechanism.

The first transport path 411 to the third transport path 413 are each formed of a combination of a roller, a belt wound on the roller, a motor that drives the roller, a sidewall, and the like. Tracking sensors that detect the passage of a banknote are provided at predetermined positions of the first transport path 411 to the third transport path 413. The control unit 15 detects the position of a banknote based on detection signals from the tracking sensors, and controls the first diverter mechanism and the second diverter mechanism, thereby transporting the banknote to a predetermined configuration.

When needed, an operation unit that outputs an operation signal based on a setting inputted by an operator to the control unit 15 may be provided. Note that, the operation unit may be provided, for example, in the front portion of the housing 10 or may be formed of an operation apparatus connected to the banknote processing apparatus 1 by a cable or wirelessly.

When needed, the memory unit 14 may be provided. The memory unit 14 stores various data to which the control unit 15 refers. For example, the memory unit 14 may store an abnormal note list 141 as illustrated in FIG. 3. The abnormal note list 141 is a list related to banknotes which are recognized as abnormal by the recognition unit 12 when the discharging processing is performed and which are therefore stored in the temporary storage unit 13. The abnormal note list 141 comprises abnormal note information 142 corresponding to each banknote. When one banknote is stored in the temporary storage unit 13, the abnormal note information 142 corresponding to the banknote is added to the abnormal note list 141 by the control unit 15. When one banknote is fed out from the temporary storage unit 13, the abnormal note information 142 corresponding to the banknote is deleted from the abnormal note list 141 by the control unit 15. The abnormal note information 142 comprises storage order information 143 and abnormality factor information 144.

The storage order information 143 indicates the order of storage of banknotes in the temporary storage unit 13. The abnormality factor information 144 indicates a factor in causing a banknote to be recognized as abnormal. As the abnormality factor information 144 of one banknote, a plurality of factors may be stored. In the example of FIG. 3, however, one factor corresponds to one banknote.

For example, the factor indicated by the abnormality factor information 144 may be an abnormality of a serial number. In a case where a serial number of a banknote read by the recognition unit 12 when the discharging processing is performed satisfies a predetermined condition, the banknote is determined as abnormal. The factor in causing the banknote to be recognized as abnormal is an abnormality of the serial number. The abnormality of a serial number may comprise "serial number-unreadable" and "serial number-disagreement". The abnormality of "serial number-unreadable" is an abnormality in which a serial number of a banknote cannot be at least partially read by the recognition unit 12. Note that, the factor indicated by the abnormality factor information 144 may be "serial number-unreadable" in a case where characters more than a number of digits set in advance cannot be read or in a case where, regardless of a number of digits that cannot be read, a character of a particular digit cannot be read. The abnormality of "serial number-disagreement" is an abnormality in which a serial number read by the recognition unit 12 when the discharging processing is performed disagrees with a predetermined serial number. The predetermined serial number is a serial number stored in advance as a serial number of a banknote to be dispensed. For example, the predetermined serial number may be a serial number stored as a serial number in a serial number list to be described later.

In a case where the recognition unit 12 recognizes the fitness of a banknote, the factor indicated by the abnormality factor information 144 may comprise "fitness abnormality". This case indicates that a banknote is recognized as an unfit note by the recognition unit 12. As factors in causing a banknote to be determined as an unfit note, it is possible to exemplify soiling, tearing, corner-folding (a folded corner of a banknote), and perforation.

A case where the factor indicated by the abnormality factor information 144 is "denomination abnormality" indicates that the denomination of a banknote recognized by the recognition unit 12 disagrees with a denomination specified based on the recycling storage apparatus 21 in which the banknote has been stored.

A case where the factor indicated by the abnormality factor information 144 is "transport abnormality" indicates that the transport interval of banknotes transported from the recycling storage apparatus 21 is equal to or less than a predetermined distance, or that banknotes are overlapped. The "transport abnormality" is detected by the recognition unit 12 or the tracking sensors.

The control unit 15 controls the banknote processing apparatus 1 in its entirety. The control unit 15 may also be referred to as a processor or a computer. Details of the processing of the control unit 15 will be described later.

(Operations of Banknote Processing Apparatus)

Next, operations of the banknote processing apparatus 1 will be described. Note that, hereinafter, the banknote recognized as normal by the recognition unit 12 means a banknote for which no abnormality to be recorded as the abnormality factor information 144 in the abnormal note list 141 is detected. The banknote recognized as abnormal by the recognition unit 12 means a banknote for which an abnormality to be recorded as the abnormality factor information 144 is detected.

(1. Dispensing Processing)

Figure 4:
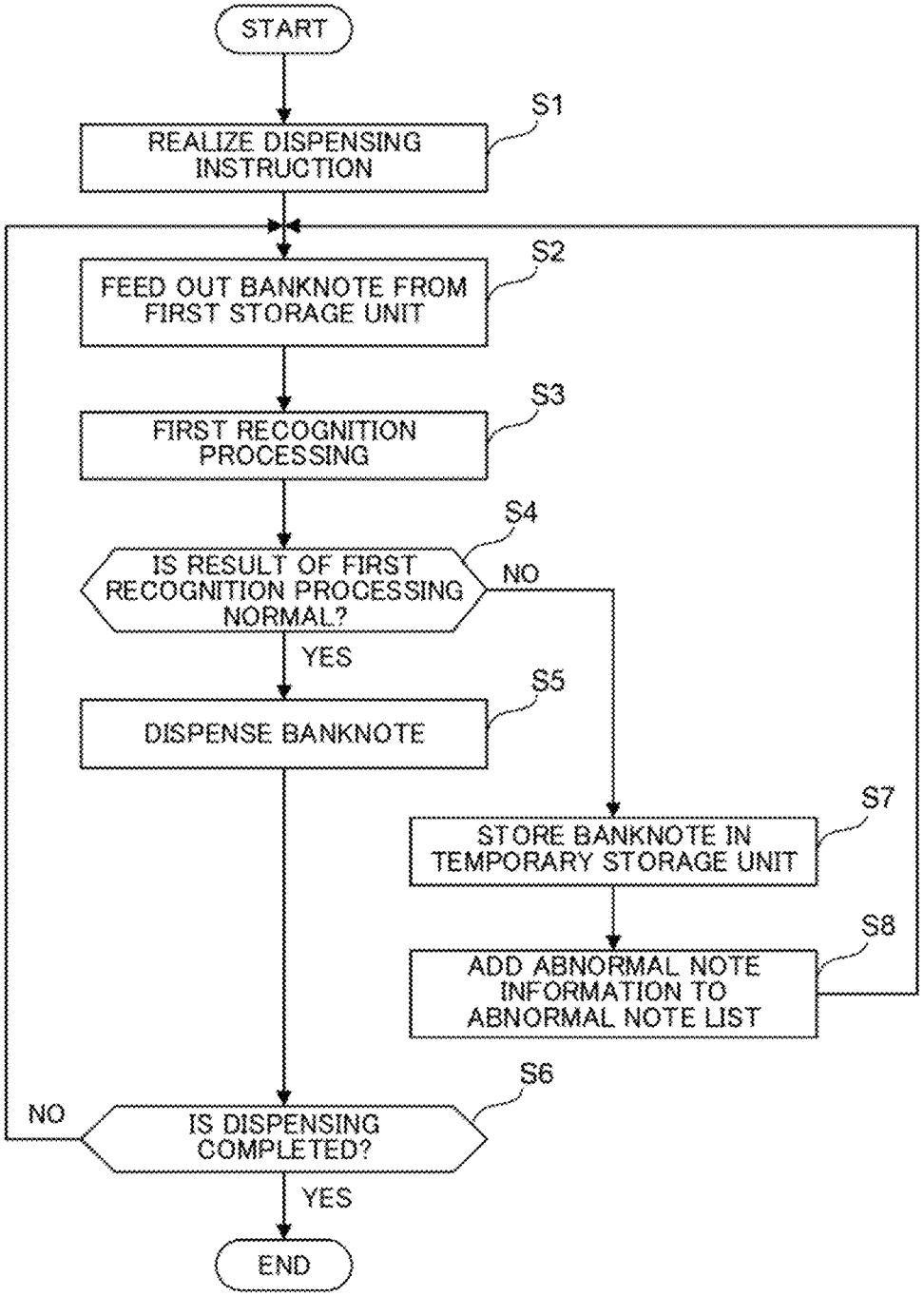
FIG. 4 is a flowchart illustrating dispensing processing according to the present disclosure.

First, as an operation of the banknote processing apparatus 1, dispensing processing that is an example of the discharging processing will be described. FIG. 4 is a flowchart illustrating the dispensing processing. Note that, a number of banknotes to be dispensed in the dispensing processing may be set and inputted by an operator, or may be determined by the control unit 15 based on a dispensing amount set and inputted by an operator.

When the control unit 15 realizes, based on an operation signal from the operation unit, a dispensing instruction of a banknote in a predetermined amount by an operator (step S1), the control unit 15 controls the recycling storage apparatus 21 of the first storage unit 2 such that one banknote is fed out (step S2).

The control unit 15 controls the transport unit 4 such that the banknote is transported to the recognition unit 12 via the third transport path 413, the lower-side path 4112, the rear reversing path 4113, and the upper-side path 4111, and the recognition unit 12 performs the first recognition processing (step S3). The control unit 15 determines whether the banknote recognized in the first recognition processing is normal (step S4).

In a case where it has been determined that the banknote is a normal note (step S4: YES), the control unit 15 controls the transport unit 4 and the dispensing unit 11 such that the banknote passes through the upper-side path 4111 and the second transport path 412 and is dispensed from the dispensing unit 11 (step S5). The control unit 15 determines whether a total amount of banknotes transported to the dispensing unit 11 has reached the dispensing amount, that is, whether the dispensing is completed (step S6). In a case where it has been determined that the dispensing is completed (step S6: YES), the control unit 15 ends the dispensing processing. In a case where it has been determined that the dispensing processing is not completed (step S6: NO), the control unit 15 performs the processing in step S2. Note that, the control unit 15 may determine that the dispensing is completed when realizing that the banknotes have been taken out from the dispensing unit 11.

In a case where it has been determined that the banknote subjected to the first recognition processing is an abnormal note (step S4: NO), the control unit 15 controls the transport unit 4 and the temporary storage unit 13 such that the banknote passes through the upper-side path 4111 and is stored in the temporary storage unit 13 (step S7). The control unit 15 adds the abnormal note information 142 of the banknote recognized as abnormal based on a result of the first recognition processing to the abnormal note list 141 (step S8), and performs the processing in step S2. Although the dispensing processing has been described thus far as an example of the discharging processing, the banknote movement is also the same in the case of the collection processing. For example, operations of the collection processing can be understood by replacing the dispensing amount described above with a collection amount or a number of collected banknotes.

(2. Storage Processing)

Figure 5:
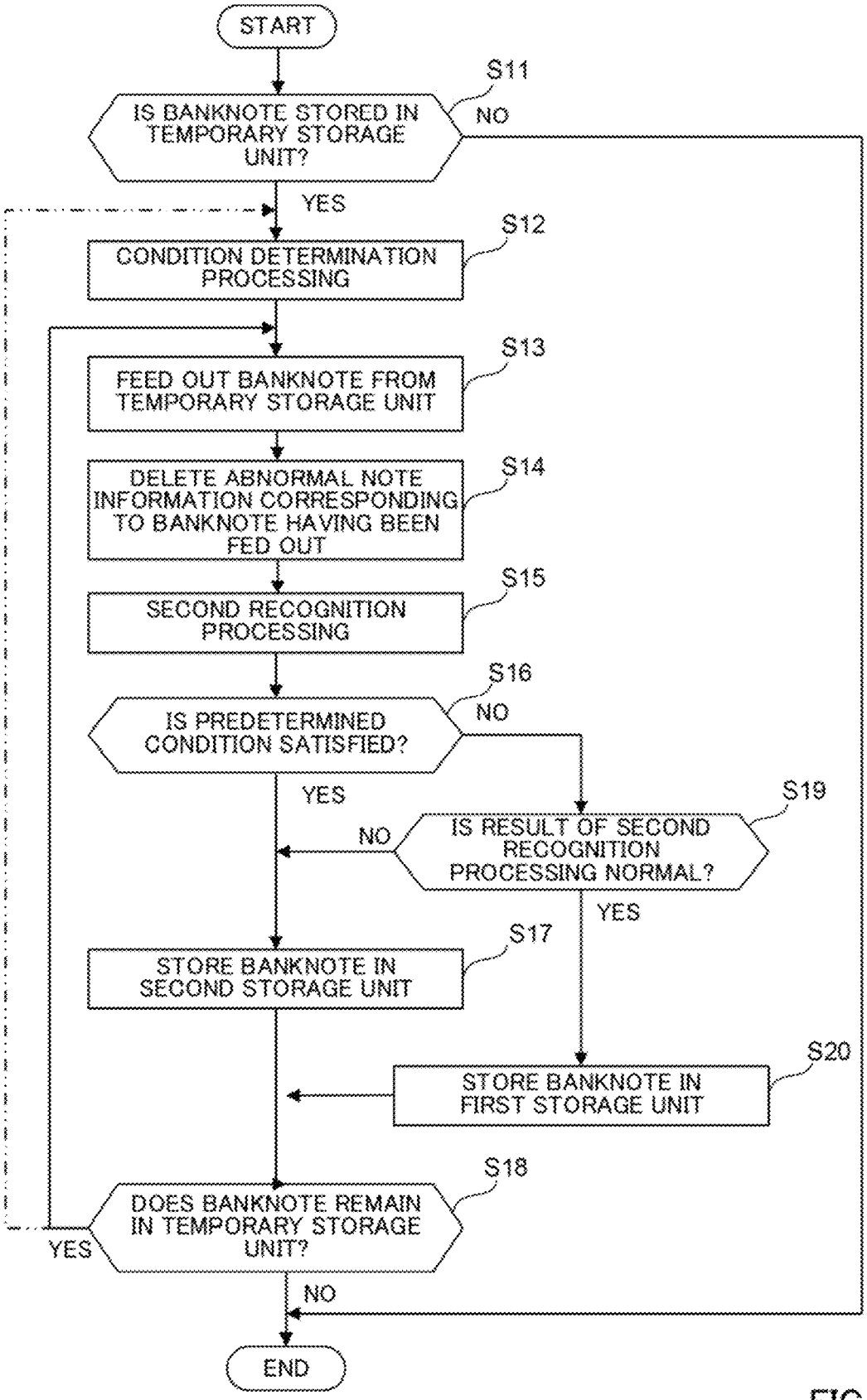
FIG. 5 is a flowchart illustrating storage processing according to the present disclosure.

Next, storage processing of a banknote stored in the temporary storage unit 13 will be described. FIG. 5 is a flowchart illustrating first storage processing and second storage processing. The first storage processing and the second storage processing are examples of the storage control processing.

When the discharging processing is completed, the control unit 15 may perform the first storage processing or the second storage processing. Hereinafter, a description will be given assuming that the dispensing processing as the discharging processing is completed. First, a description will be given of the first storage processing.

As illustrated in FIG. 5, the control unit 15 determines whether a banknote is stored in the temporary storage unit 13 (step S11). In a case where it has been determined that no banknote is stored in the temporary storage unit 13 (step S11: NO), the control unit 15 ends the storage processing. In a case where it has been determined that a banknote is stored in the temporary storage unit 13 (step S11: YES), the control unit 15 performs condition determination processing (step S12).

In the condition determination processing, the control unit 15 determines whether a predetermined condition is satisfied. As the predetermined condition, it is possible to exemplify a condition 1-1 and a condition 1-2 described below. In the condition determination processing, the control unit 15 may determine only one of the conditions 1-1 and 1-2 or both the conditions. In the condition determination processing, the control unit 15 may use both the conditions 1-1 and 1-2 as determination objects, determine that the predetermined condition is satisfied in a case where one of the conditions of the determination objects is satisfied, and determine that the predetermined condition is not satisfied in a case where all the conditions of the determination objects are not satisfied.

The condition 1-1 is a condition related to the number of banknotes stored in the first storage unit 2. For example, the condition 1-1 is a condition that the number of banknotes stored in the recycling storage apparatus 21 at a time when the dispensing processing ends is equal to or less than a first threshold value. In a case where the number of banknotes stored in the recycling storage apparatus 21 is equal to or less than the first threshold value, the control unit 15 determines that the predetermined condition is satisfied. In a case where the number of banknotes stored in the recycling storage apparatus 21 exceeds the first threshold value, the control unit 15 determines that the predetermined condition is not satisfied. Note that, the condition 1-1 may also be a condition that the number of banknotes stored in the first storage unit 2 at a time when a predetermined banknote is ejected from the temporary storage unit 13 is equal to or less than the first threshold value. Note that, the control unit 15 may realize the number of banknotes stored in the recycling storage apparatus 21 based on a counting result of a number of banknotes put into and taken out from the recycling storage apparatus 21 and/or based on a detection result of the weight of banknotes. Further, the control unit 15 may determine whether not the number of banknotes stored in the recycling storage apparatus 21, but the weight of banknotes is equal to or less than the first threshold value.

The control unit 15 may realize the banknote storage state in the recycling storage apparatus 21 based on a detection result of the sensor 215. In this case, when the storage state detected by the sensor 215 is "empty" or "near empty", the control unit 15 determines that the condition related to the number of stored banknotes is satisfied, and when the storage state is neither "empty" nor "near empty", the control unit 15 may determine that the condition related to the number of stored banknotes is not satisfied.

The condition 1-2 is a condition related to a number of banknotes stored in the temporary storage unit 13. For example, the condition 1-2 is a condition that the number of banknotes stored in the temporary storage unit 13 at the time when the dispensing processing ends is equal to or less than a second threshold value. In a case where the number of banknotes stored in the temporary storage unit 13 is equal to or less than the second threshold value, the control unit 15 determines that the predetermined condition is satisfied. In a case where the number of banknotes stored in the temporary storage unit 13 exceeds the second threshold value, the control unit 15 determines that the predetermined condition is not satisfied. Note that, the condition 1-2 may also be a condition that the number of banknotes stored in the temporary storage unit 13 at a time when a predetermined banknote is ejected from the temporary storage unit 13 is equal to or less than the second threshold value.

The control unit 15 may realize the number of banknotes stored in the temporary storage unit 13 based on a number of the abnormal note information 142 in the abnormal note list 141 at the time when the dispensing processing ends and/or based on a content of the storage order information 143.

When the condition determination processing is performed, the control unit 15 controls the temporary storage unit 13 such that one banknote is fed out (step S13). The control unit 15 deletes the abnormal note information 142 corresponding to the banknote, which has been fed out, from the abnormal note list 141 (step S14). The control unit 15 controls the transport unit 4 such that the banknote is transported to the recognition unit 12 via the upper-side path 4111, and the recognition unit 12 performs second recognition processing (step S15). The content of the second recognition processing is the same as that of the first recognition processing. The control unit 15 determines whether it has been determined in the condition determination processing that the predetermined condition is satisfied (step S16).

In a case where it has been determined that the predetermined condition is satisfied (step S16: YES), the control unit 15 controls the transport unit 4 and the second storage unit 3 such that the banknote passes through the upper-side path 4111, the rear reversing path 4113, and the lower-side path 4112 and is stored in the second storage unit 3 (step S17). That is, the control unit 15 causes the banknote to be stored in the second storage unit 3 regardless of a recognition result in the second recognition processing.

The control unit 15 determines whether a banknote remains in the temporary storage unit 13 (step S18). The control unit 15 may determine whether a banknote remains in the temporary storage unit 13, for example, based on a counting result of a number of banknotes put into and taken out from the temporary storage unit 13 and/or based on a content of the abnormal note list 141. In a case where it has determined that no banknote remains in the temporary storage unit 13 (step S18: NO), the control unit 15 ends the storage processing. In a case where it has been determined that a banknote remains in the temporary storage unit 13 (step S18: YES), the control unit 15 performs the processing in step S13 as indicated by a solid line.

In a case where it has been determined in the condition determination processing that the predetermined condition is not satisfied (step S16: NO), the control unit 15 determines whether a result of the second recognition processing of the banknote is normal (step S19). In a case where it has been determined that the result of the second recognition processing is normal (step S19: YES), the control unit 15 controls the transport unit 4 and the first storage unit 2 such that the banknote passes through the upper-side path 4111, the rear reversing path 4113, the lower-side path 4112, and the third transport path 413 and is stored in the first storage unit 2 (step S20). The control unit 15 performs the processing in step S18. In a case where it has been determined that the result of the second recognition processing is abnormal (step S19: NO), the control unit 15 performs the processing in step S17. That is, the control unit 15 causes the banknote to be stored in the second storage unit 3.

Next, the second storage processing will be described. The first storage processing and the second storage processing are common except the following two points:

Difference 1-1: the content of the condition determination processing in step S12, and Difference 1-2: in a case where it has been determined in step S18 that a banknote remains in the temporary storage unit 13, not the processing in step S13, but the processing in step S12 is performed.

The difference 1-1 will be described. In the condition determination processing in step S12, the control unit 15 determines whether a condition 1-3 described below is satisfied.

The condition 1-3 is a condition related to a factor in causing a banknote to be recognized as abnormal in the first recognition processing. For example, the condition 1-3 is a condition that the factor in causing a banknote to be recognized as abnormal is an abnormality of a serial number ("serial number-unreadable" or "serial number-disagreement"). In a case where an abnormality of a banknote is an abnormality of a serial number, the control unit 15 determines that only the banknote is a banknote for which the predetermined condition is satisfied. In a case where an abnormality of a banknote is an abnormality other than an abnormality of a serial number, the control unit 15 determines that only the banknote is a banknote for which the predetermined condition is not satisfied. The control unit 15 may also realize an abnormality factor of a banknote based on a content of the abnormality factor information 144 in the abnormal note list 141.

The difference 1-2 will be described. In a case where it has been determined in step S18 that a banknote remains in the temporary storage unit 13, the control unit 15 performs the processing in step S12 as indicated by a two-dot chain line in FIG. 5. That is, in the first storage processing, a result of the condition determination processing in step S12 performed once is applied to all banknotes stored in the temporary storage unit 13, whereas in the second storage processing, the condition determination processing in step S12 is performed on each banknote stored in the temporary storage unit 13 and it is determined whether the predetermined condition is satisfied.

In the first storage processing and the second storage processing, the processing in step S19 that is performed following step S16 is an example of the first processing. The processing in steps S19, S20, and S17 that are performed following step S16 are examples of the second processing.

Note that, in the first storage processing and the second storage processing, the condition determination processing may be performed after the second recognition processing is performed. In this case, the control unit 15 may perform the processing in steps S12 to S15 in the order of step S13, step S15, step S12, and step S14, or in the order of step S13, step S12, step S14, and step S15.

(Working Effects of Embodiment 1)

Embodiment 1 described above exhibits working effects as described below.

When a banknote stored in the temporary storage unit 13 in the dispensing processing, that is, a banknote recognized as abnormal in the first recognition processing is determined as normal in the second recognition processing, the banknote is stored in the first storage unit 2 and is subjected to the first recognition processing at a time of the next dispensing processing. A banknote that is stored in the temporary storage unit 13 and is then returned to the first storage unit 2 may be recognized as an abnormal note again in the first recognition processing and may be stored in the temporary storage unit 13. When a banknote that is stored in the temporary storage unit 13 and is then returned to the first storage unit 2 is stored in the temporary storage unit 13 again as described above, the dispensing efficiency may decrease.

To suppress a decrease in the dispensing efficiency as described above, the control unit 15 causes a banknote stored in the temporary storage unit 13 to be stored in the second storage unit 3 in a case where the predetermined condition is satisfied in the first storage processing or the second storage processing. In a case where the predetermined condition is not satisfied, the control unit 15 causes, of banknotes stored in the temporary storage unit 13, a banknote recognized as normal in the second recognition processing to be stored in the first storage unit 2, and causes, of the banknotes stored in the temporary storage unit 13, a banknote recognized as abnormal in the second recognition processing to be stored in the second storage unit 3.

First, a description will be given of a reason why it is possible to suppress a decrease in the dispensing efficiency in a case where the predetermined condition in the first storage processing is the condition 1-1.

It is considered that banknotes stored in the first storage unit 2 at the time when the dispensing processing ends comprise a predetermined proportion of banknotes that are recognized as normal in the first recognition processing. Accordingly, in a case where the number of banknotes stored in the first storage unit 2 exceeds the first threshold value, the first storage unit 2 highly likely comprises more banknotes that are recognized as normal in the first recognition processing, in comparison with a case where the number of banknotes stored in the first storage unit 2 is equal to or less than the first threshold value. Accordingly, in a case where the number of banknotes stored in the first storage unit 2 exceeds the first threshold value, it is possible to complete the dispensing by returning all banknotes stored in the temporary storage unit 13 to the first storage unit 2 and by dispensing, even when the returned banknotes are recognized as abnormal in the first recognition processing, other banknotes stored in the first storage unit 2.

In a case where the number of banknotes stored in the first storage unit 2 at the time when the dispensing processing ends is equal to or less than the first threshold value, on the other hand, the dispensing may not be completed by returning all banknotes stored in the temporary storage unit 13 to the first storage unit 2 when the returned banknotes are recognized as abnormal in the first recognition processing. In this case, even when other banknotes stored in the first storage unit 2 are dispensed, a dispensing amount may not be reached.

Accordingly, in a case where the number of banknotes stored in the first storage unit 2 at the time when the dispensing processing ends is equal to or less than the first threshold value, the control unit 15 causes all banknotes stored in the temporary storage unit 13 to be stored in the second storage unit 3, and excludes the banknotes from dispensing objects. After such processing, an operator is capable of replenishing the first storage unit 2 with banknotes based on the number of banknotes stored in the first storage unit 2 after the first storage processing. Accordingly, in the dispensing processing after the first storage processing, it is possible to suppress a situation in which the dispensing is not completed, and it is possible to suppress a decrease in the dispensing efficiency.

Next, a description will be given of a reason why it is possible to suppress a decrease in the dispensing efficiency in a case where the predetermined condition in the first storage processing is the condition 1-2.

It is considered that banknotes stored in the temporary storage unit 13 comprise a predetermined proportion of banknotes that are recognized as normal in a case where the first recognition processing is performed again. Accordingly, in a case where the number of banknotes stored in the temporary storage unit 13 at the time when the dispensing processing ends exceeds the second threshold value, the temporary storage unit 13 highly likely comprises more banknotes that are recognized as normal in a case where the first recognition processing is performed again, in comparison with a case where the number of banknotes stored in the temporary storage unit 13 at the time when the dispensing processing ends is equal to or less than the second threshold value. Accordingly, a case where all banknotes stored in the temporary storage unit 13 are returned to the first storage unit 2 results in an increase in, of the returned banknotes, banknotes to be dispensed, and does not lead to a decrease in the dispensing efficiency.

In a case where the number of banknotes stored in the temporary storage unit 13 at the time when the dispensing processing ends is equal to or less than the second threshold value, on the other hand, the temporary storage unit 13 highly likely comprises fewer banknotes that are recognized as normal in a case where the first recognition processing is performed again, in comparison with a case where the number of banknotes stored in the temporary storage unit 13 exceeds the second threshold value. Accordingly, a case where all banknotes stored in the temporary storage unit 13 are returned to the first storage unit 2 may result in a decrease in, of the returned banknotes, banknotes to be dispensed, in comparison with a case where the number of banknotes stored in the temporary storage unit 13 exceeds the second threshold value. That is, banknotes recognized as abnormal in the first recognition processing may increase and the dispensing efficiency may decrease.

Accordingly, in a case where the number of banknotes stored in the temporary storage unit 13 at the time when the dispensing processing ends is equal to or less than the second threshold value, the control unit 15 causes all banknotes stored in the temporary storage unit 13 to be stored in the second storage unit 3, and excludes the banknotes from dispensing objects. The control unit 15 performs such processing, and thus, it is possible to suppress a decrease in the dispensing efficiency.

Next, a description will be given of a reason why it is possible to suppress a decrease in the dispensing efficiency in a case where the predetermined condition in the second storage processing is the condition 1-3.

The recognition unit 12 performs recognition processing of a banknote by using an image sensor or the like. However, even in a case where the same banknote is recognized, different recognition results may be obtained when a distance between the image sensor and a recognition part of the banknote varies. For example, a serial number, and tearing, soiling, perforation and the like of a banknote may be or may not be recognizable. Banknote warpage is considered to be a reason why the distance between the image sensor and the recognition part of a banknote varies.

For example, when a banknote passes through a bent part of a transport path, the banknote warps in accordance with the shape of the transport path. This banknote warpage gradually disappears as a transport distance on the transport path that is not bent increases.

When the first recognition processing is performed, a banknote is transported from the first storage unit 2 to the recognition unit 12 via the third transport path 413, the rear reversing path 4113, and the upper-side path 4111. Since the direction in which the rear reversing path 4113 extends differs from the direction in which the upper-side path 4111 extends, the banknote warps when transported from the rear reversing path 4113 to the upper-side path 4111. Thereafter, the banknote is transported on the upper-side path 4111 that horizontally extends, but may be subjected to the recognition by the recognition unit 12 in a state in which the warpage does not disappear since the transport distance to the recognition unit 12 is short.

When the second recognition processing is performed, on the other hand, a banknote is transported from the temporary storage unit 13 to the recognition unit 12 via the upper-side path 4111. That is, the direction in which the banknote passes through the recognition unit 12 varies between the first recognition processing and the second recognition processing. Assuming that a banknote is bent when stored in the temporary storage unit 13, the banknote is transported on the upper-side path 4111 that horizontally extends, and the transport distance to the recognition unit 12 is longer than that at a time of the first recognition processing. Accordingly, the banknote is highly likely subjected to recognition by the recognition unit 12 in a state in which the warpage is smaller than that at the time of the first recognition processing.

A case where banknote warpage at a time of the second recognition processing is smaller than that at the time of the first recognition processing may cause a situation in which the serial number that is not recognized in the first recognition processing is recognized in the second recognition processing. When such a situation occurs, the banknote reciprocates between the first storage unit 2 and the temporary storage unit 13 when the dispensing processing and the storage processing are performed, and the dispensing efficiency may decrease.

Accordingly, in a case where a factor in causing a banknote to be recognized as abnormal is an abnormality of a serial number ("serial number-unreadable"), the control unit 15 causes the banknote to be stored in the second recognition 3, and excludes the banknote from dispensing objects. The control unit 15 performs such processing, and thus, it is possible to suppress a decrease in the dispensing efficiency.

The control unit 15 causes the second recognition processing to be performed on all banknotes stored in the temporary storage unit 13 regardless of whether the banknotes are banknotes for which the conditions 1-1, 1-2, and 1-3 are satisfied. Accordingly, there is no need to change the control of the recognition unit 12 depending on whether the banknotes are banknotes for which the conditions 1-1, 1-2, and 1-3 are satisfied.

The control unit 15 causes a banknote to pass through the upper-side path 4111, the rear reversing path 4113, and the lower-side path 4112 regardless of whether the banknote is a banknote for which the conditions 1-1, 1-2, and 1-3 are satisfied. Accordingly, it is possible to suppress a decrease in the dispensing efficiency in a state in which a change in a banknote transport route is suppressed to the minimum.

Embodiment 2

(Configuration of Banknote Processing Apparatus)

Next, a configuration of a banknote processing apparatus in Embodiment 2 of the present disclosure will be described. FIG. 6 is a schematic diagram illustrating a configuration of an abnormal note list. Note that, a banknote processing apparatus 1A in Embodiment 2 is an example of the banknote processing apparatus 1 of Embodiment 1. The same configurations as those of the banknote processing apparatus 1 of Embodiment 1 will be denoted by the same reference signs, and descriptions thereof will be simplified or omitted.

The banknote processing apparatus 1A of Embodiment 2 and the banknote processing apparatus 1 of Embodiment 1 that are illustrated in FIG. 1 differ in that the banknote processing apparatus 1A comprises a first storage unit 2A instead of the first storage unit 2, in that the banknote processing apparatus 1A comprises a transport unit 4A instead of the transport unit 4, in the content of the abnormal note list stored in the memory unit 14, and in the processing content of the control unit 15.

As indicated by a solid line and a two-dot chain line in FIG. 1, the first storage unit 2A comprises a plurality of recycling storage apparatuses 21. Note that, hereinafter, one of two recycling storage apparatuses 21 may be referred to as "first recycling storage apparatus 21A", and the other thereof may be referred to as "second recycling storage apparatus 21B". The denominations of banknotes that are stored in the first recycling storage apparatus 21A and the second recycling storage apparatus 21B are set differently in advance, respectively. Note that, at least one of the first recycling storage apparatus 21A and the second recycling storage apparatus 21B may be formed of a tape-type storing unit that uses a strip-shaped tape attached to the outer peripheral surface of a drum to wind a banknote on the drum together with the tape. Further, three or more recycling storage apparatuses 21 may form the first storage unit 2A. In this case, the denominations of banknotes that are stored in the respective recycling storage apparatuses 21 preferably differ from each other.

The transport unit 4A comprises the first transport path 411 to the third transport path 413 indicated by solid lines in FIG. 1, and a fourth transport path 414 indicated by a two-dot chain line in FIG. 1.

The third transport path 413 connects the lower-side path 4112 and the first recycling storage apparatus 21A. The fourth transport path 414 connects the second recycling storage apparatus 21B and a position of the lower-side path 4112, where the position is on the rear side of a connection part between the lower-side path 4112 and the third transport path 413. A connection part between the fourth transport path 414 and the lower-side path 4112 is provided with a third diverter mechanism. In the same manner as the first transport path 411 to the third transport path 413, the fourth transport path 414 is formed of a combination of a roller, a belt, a motor, a sidewall, and the like. A tracking sensor(s) that detect(s) the passage of a banknote is/are provided at a predetermined position(s) of the fourth transport path 414. The control unit 15 detects the position of a banknote based on detection signals from the tracking sensors, and controls the first diverter mechanism to the third diverter mechanism, thereby transporting the banknote to a predetermined configuration.

The memory unit 14 stores an abnormal note list 141A as illustrated in FIG. 6. The abnormal note list 141A comprises abnormal note information 142A corresponding to each banknote. The abnormal note information 142A comprises the storage order information 143, the abnormality factor information 144, and feeding source information 145A. The feeding source information 145A indicates the recycling storage apparatus 21 (the first recycling storage apparatus 21A or the second recycling storage apparatus 21B) in which a banknote has been stored before the discharging processing starts.

(Operations of Banknote Processing Apparatus)

Next, operations of the banknote processing apparatus 1A will be described. Note that, the dispensing processing as an example of the discharging processing and the second storage processing are the same as those in Embodiment 1. Accordingly, descriptions thereof will be omitted, and the first storage processing will be described. Note that, descriptions of the same processing as the first storage processing of Embodiment 1 will be simplified or omitted.

(1. First Storage Processing)

The first storage processing of Embodiment 2 and the first storage processing of Embodiment 1 are common except the following three points:

Difference 2-1: the content of the condition determination processing in step S12, Difference 2-2: the content of the processing in step S20, and Difference 2-3: in a case where it has been determined in step S18 that a banknote remains in the temporary storage unit 13, not the processing in step S13 but the processing in step S12 is performed.

The difference 2-1 will be described. In the condition determination processing in step S12 illustrated in FIG. 5, the control unit 15 determines whether conditions 2-1 and 2-2 described below are satisfied. In the condition determination processing, the control unit 15 may also determine only one of the conditions 2-1 and 2-2 or both the conditions. In the condition determination processing, the control unit 15 may use both the conditions 2-1 and 2-2 as determination objects, determine that the predetermined condition is satisfied in a case where one of the conditions of the determination objects is satisfied, and determine that the predetermined condition is not satisfied in a case where all the conditions of the determination objects are not satisfied.

The condition 2-1 is a condition related to a number of banknotes stored in the first storage unit 2A. For example, the condition 2-1 is a condition that the number of banknotes stored in the recycling storage apparatus 21, in which a banknote (a storage object banknote) that is to be fed out from the temporary storage unit 13 and is to be stored in the first storage unit 2A or the second storage unit 3 has been originally (previously) stored, is equal to or less than a first threshold value at the time when the dispensing processing ends. Note that, the first threshold value in Embodiment 2 may be the same as or different from the first threshold value in Embodiment 1. Further, the condition 2-1 may also be a condition that the number of banknotes stored in the recycling storage apparatus 21 in which a storage object banknote has been originally stored is equal to or less than the first threshold value at a time when the storage object banknote is fed out.

When the condition determination processing in step S12 is performed, the control unit 15 realizes, based on the abnormal note list 141A, the recycling storage apparatus 21 (the first recycling storage apparatus 21A or the second recycling storage apparatus 21B) in which a banknote (a storage object banknote) to be fed out from the temporary storage unit 13 has been originally stored. For example, in a case where the realized recycling storage apparatus 21 is the first recycling storage apparatus 21A, the control unit 15 determines that the predetermined condition is satisfied when a number of banknotes stored in the first recycling storage apparatus 21A at the time when the dispensing processing ends is equal to or less than the first threshold value, and the control unit 15 determines that the predetermined condition is not satisfied when the number of banknotes stored in the first recycling storage apparatus 21A at the time when the dispensing processing ends exceeds the first threshold value.

The condition 2-2 is a condition related to the number of banknotes stored in the temporary storage unit 13. For example, the condition 2-2 is a condition that, of banknotes stored in the temporary storage unit 13 at the time when the dispensing processing ends, a total number of banknotes having been stored in the recycling storage apparatus 21 that is the same recycling storage apparatus 21 in which a storage object banknote has been originally stored is equal to or less than a second threshold value. Note that, the second threshold value in Embodiment 2 may be the same as or different from the second threshold value in Embodiment 1. Further, the condition 2-2 may be a condition that the total number of banknotes having been stored in the recycling storage apparatus 21 that is the same recycling storage apparatus 21 in which a storage object banknote has been originally stored is equal to or less than the first threshold value at a time when the storage object banknote is fed out.

When the condition determination processing in step S12 is performed, the control unit 15 realizes, based on the abnormal note list 141A, the recycling storage apparatus 21 (the first recycling storage apparatus 21A or the second recycling storage apparatus 21B) in which a banknote that is to be fed out from the temporary storage unit 13 has been stored. For example, in a case where the realized recycling storage apparatus 21 is the first recycling storage apparatus 21A, the control unit 15 determines that the predetermined condition is satisfied when, of banknotes stored in the temporary storage unit 13 at the time when the dispensing processing ends, a total number of banknotes having been stored in the first recycling storage apparatus 21A is equal to or less than the second threshold value, and the control unit 15 determines that the predetermined condition is not satisfied when, of the banknotes stored in the temporary storage unit 13 at the time when the dispensing processing ends, the total number of banknotes having been stored in the first recycling storage apparatus 21A exceeds the second threshold value.

The difference 2-2 will be described. In step S20, the control unit 15 causes a banknote determined as normal in the processing in step S19 to be stored in the first recycling storage apparatus 21A or the second recycling storage apparatus 21B (the first storage unit 2A) corresponding to the banknote.

The difference 2-3 will be described. In a case where it has been determined in step S18 that a banknote remains in the temporary storage unit 13, the control unit 15 performs the processing in step S12 as indicated by the two-dot chain line in FIG. 5. That is, in the first storage processing of Embodiment 1, it is determined by the condition determination processing of step S12 performed once whether all banknotes stored in the temporary storage unit 13 are subjected to the second recognition processing in step S19, whereas in the first storage processing of Embodiment 2, the condition determination processing in step S12 is performed a plurality of times, and it is determined whether each banknote stored in the temporary storage unit 13 is subjected to the second recognition processing in step S19.

(Working Effects of Embodiment 2)

Embodiment 2 described above exhibits, in addition to the same working effects as those exhibited by Embodiment 1, working effects as described below.

When the condition determination processing is performed, the control unit 15 realizes the recycling storage apparatus 21 in which a storage object banknote has been originally stored, the control unit 15 determines that the predetermined condition is satisfied when the number of banknotes stored in the realized recycling storage apparatus 21 at the time when the dispensing processing ends is equal to or less than the first threshold value, and the control unit 15 determines that the predetermined condition is not satisfied when the number of banknotes stored in the realized recycling storage apparatus 21 at the time when the dispensing processing ends exceeds the first threshold value. Further, when the condition determination processing is performed, the control unit 15 realizes the recycling storage apparatus 21 in which a storage object banknote has been stored, the control unit 15 determines that the predetermined condition is satisfied when, of banknotes stored in the temporary storage unit 13 at the time when the dispensing processing ends, the total number of banknotes having been stored in the realized recycling storage apparatus 21 is equal to or less than the second threshold value, and the control unit 15 determines that the predetermined condition is not satisfied when, of the banknotes stored in the temporary storage unit 13 at the time when the dispensing processing ends, the total number of banknotes having been stored in the realized recycling storage apparatus 21 exceeds the second threshold value. In these cases, it is possible to determine whether a banknote is excluded from dispensing objects for each denomination corresponding to each recycling storage apparatus 21, and it is possible to suppress a decrease in the dispensing efficiency for each denomination.

Embodiment 3

(Configuration of Banknote Processing Apparatus)

Figure 7:
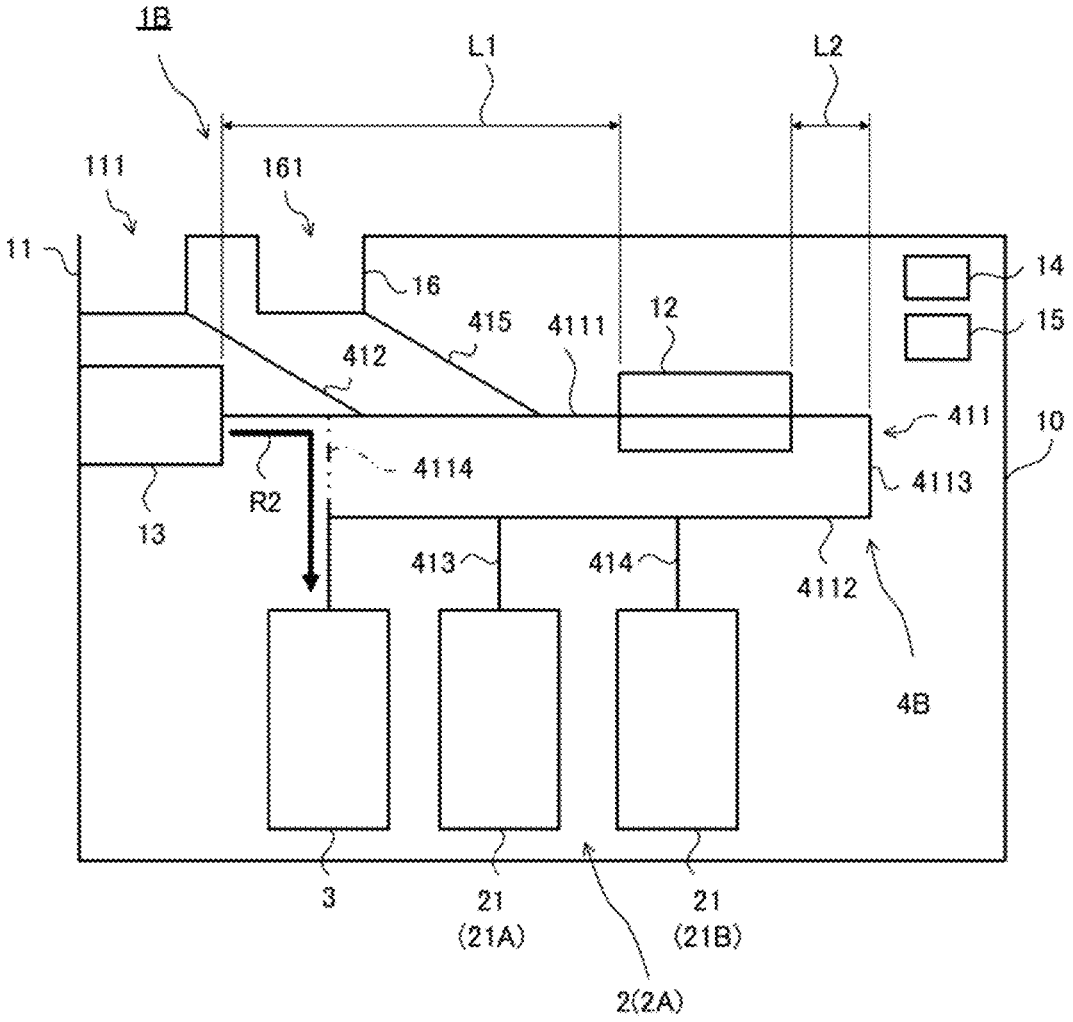
FIG. 7 is a schematic diagram illustrating an overview of an internal configuration of a banknote processing apparatus according to the present disclosure.

Next, a configuration of a banknote processing apparatus in Embodiment 3 of the present disclosure will be described. FIG. 7 is a block diagram illustrating an overview of an internal configuration of the banknote processing apparatus. FIG. 8 is a schematic diagram illustrating a configuration of a serial number list. Note that, a banknote processing apparatus 1B in Embodiment 3 is an example of the banknote processing apparatus 1 of Embodiment 1. The same configurations as those of the banknote processing apparatus 1 of Embodiment 1 or the banknote processing apparatus 1A of Embodiment 2 will be denoted by the same reference signs, and descriptions thereof will be simplified or omitted.

The banknote processing apparatus 1B of Embodiment 3 illustrated in FIG. 7 and the banknote processing apparatus 1A of Embodiment 2 differ in that the banknote processing apparatus 1B further comprises a depositing unit 16, in that the banknote processing apparatus 1B comprises a transport unit 4B instead of the transport unit 4, in the content of the list stored in the memory unit 14, and in the processing content of the control unit 15.

The depositing unit 16 is an example of an inlet section into which a banknote is inserted. The depositing unit 16 is a portion into which a banknote is inserted when depositing processing of a banknote is performed, for example. The depositing unit 16 is configured so as to be capable of stacking a plurality of banknotes in an overlapping state. The depositing unit 16 comprises an inlet 161, and a feeding mechanism. In the front portion of the housing 10 and rearward from the outlet 111, the inlet 161 is provided to open upward. The feeding mechanism takes in (receives) a plurality of banknotes stacked in the depositing unit 16 one by one into the housing 10.

The transport unit 4B comprises the first transport path 411 to the fourth transport path 414 and a fifth transport path 415.

The fifth transport path 415 connects the depositing unit 16 and a position of the upper-side path 4111, where the position is on the rear side of a connection part between the upper-side path 4111 and the second transport path 412 and is on the front side of the recognition unit 12. The fifth transport path 415 is provided so as to extend from the upper-side path 4111 frontward and obliquely upward (in a third direction), that is, so as to extend in a direction different from the direction in which the rear reversing path 4113 extends. A connection part between the fifth transport path 415 and the upper-side path 4111 is provided with a fourth diverter mechanism. In the same manner as in the first transport path 411 to the fourth transport path 414, the fifth transport path 415 is formed of a combination of a roller, a belt, a motor, a sidewall, and the like. A tracking sensor(s) that detect(s) the passage of a banknote is/are provided at a predetermined position(s) of the fifth transport path 415. The control unit 15 detects the position of a banknote based on detection signals from the tracking sensors, and controls the first diverter mechanism to the fourth diverter mechanism, thereby transporting the banknote to a predetermined configuration.

The memory unit 14 stores a serial number list 241B as illustrated in FIG. 8 and the abnormal note list 141A illustrated in FIG. 6.

The serial number list 241B is a list of banknotes recognized as normal by the recognition unit 12 when the depositing processing is performed. The memory unit 14 stores the serial number lists 241B of the respective recycling storage apparatuses 21 forming the first storage unit 2. That is, in Embodiment 3, the memory unit 14 stores the serial number list 241B of the first recycling storage apparatus 21A and the serial number list 241B of the second recycling storage apparatus 21B. The serial number list 241B comprises banknote information 242B corresponding to each banknote. For example, when one banknote is stored in the first recycling storage apparatus 21A, the control unit 15 adds the banknote information 242B corresponding to the banknote to the serial number list 241B of the first recycling storage apparatus 21A. For example, when one banknote is fed out from the first recycling storage apparatus 21A, the control unit 15 deletes the banknote information 242B corresponding to the banknote from the serial number list 241B of the first recycling storage apparatus 21A. The banknote information 242B comprises storage order information 243B and serial number information 244B.

The storage order information 243B indicates the order of storage of banknotes in the recycling storage apparatus 21. The serial number information 244B indicates the serial numbers of banknotes.

Note that, one serial number list 241B may comprises the banknote information 242B of the respective recycling storage apparatuses 21 forming the first storage unit 2. In this case, the banknote information 242B preferably comprises storage destination information indicating the recycling storage apparatus 21 (the first recycling storage apparatus 21A or the second recycling storage apparatus 21B) in which a banknote is stored.

Abnormality factors indicated by the abnormality factor information 144 of Embodiment 3 comprise "serial number-disagreement" that is one abnormality factor of a serial number. A case where an abnormality factor indicated by the abnormality factor information 144 is "serial number-disagreement" indicates that a serial number of a banknote recognized by the recognition unit 12 in the first recognition processing when the discharging processing is performed disagrees with a serial number of the serial number information 244B in the banknote information 242B corresponding to the banknote.

(Operations of Banknote Processing Apparatus)

Next, operations of the banknote processing apparatus 1B will be described. In Embodiment 3, depositing processing is performed in addition to the dispensing processing as an example of the discharging processing, the first storage processing, and the second storage processing that are performed in Embodiment 2. Regarding the dispensing processing, the first storage processing, and the second storage processing, only differences thereof between Embodiment 3 and Embodiments 1 and 2 will be described.

(1. Depositing Processing)

First, the depositing processing will be described. When the control unit 15 realizes a banknote depositing instruction by an operator based on an operation signal from the operation unit, the control unit 15 controls the feeding mechanism of the depositing unit 16 such that one banknote is fed out from the depositing unit 16.

The control unit 15 controls the transport unit 4B such that the banknote is transported to the recognition unit 12 via the fifth transport path 415 and the upper-side path 4111, and the recognition unit 12 performs third recognition processing. The content of the third recognition processing is the same as those of the first recognition processing and the second recognition processing. The direction in which the banknote passes through the recognition unit 12 varies between the first recognition processing and the third recognition processing. The control unit 15 determines whether the banknote recognized in the third recognition processing is normal.

In a case where it has been determined that the banknote is a normal note, the control unit 15 controls the transport unit 4B and the first storage unit 2A such that the banknote is stored in the first storage unit 2A (the first recycling storage apparatus 21A or the second recycling storage apparatus 21B) corresponding to the banknote. For example, the control unit 15 causes the banknote to pass through at least the upper-side path 4111, the rear reversing path 4113 and the lower-side path 4112 and to be stored in the first recycling storage apparatus 21A. The control unit 15 adds the banknote information 242B of the banknote recognized as normal based on a result of the third recognition processing to the serial number list 241B.

In a case where it has been determined in the third recognition processing that the banknote is an abnormal note, on the other hand, the control unit 15 controls the transport unit 4B such that the banknote is dispensed from the dispensing unit 11.

The control unit 15 repeats the processing to cause a banknote to be stored in the first storage unit 2A or the second storage unit 3 based on a result of the third recognition processing until there is no banknote in the depositing unit 16. Note that, the control unit 15 may cause a banknote determined as normal in the third recognition processing to be stored in the temporary storage unit 13. After there is no banknote in the depositing unit 16 and a depositing amount is accepted, the control unit 15 causes a banknote stored in the temporary storage unit 13 to be stored in the first storage unit 2A (the first recycling storage apparatus 21A or the second recycling storage apparatus 21B) corresponding to the banknote.

(2. Dispensing Processing)

Next, the dispensing processing will be described. The dispensing processing of Embodiment 3 and the dispensing processing of Embodiments 1 and 2 are common except the following three points:

Difference 3-1: in the first recognition processing in step S3, it is recognized whether a serial number of a banknote recognized by the recognition unit 12 agrees with a serial number of the serial number information 244B in the banknote information 242B corresponding to the banknote, Difference 3-2: after the first recognition processing in step S3, the banknote information 242B corresponding to a dispensed banknote is deleted from the serial number list 241B (after the first recognition processing on a predetermined banknote is performed, the banknote information 242B corresponding to the predetermined banknote may be deleted before the first recognition processing on the next banknote is performed, or after dispensing of banknotes in a dispensing amount is completed, the banknote information 242B corresponding to all the dispensed banknotes may be deleted altogether), and Difference 3-3: in step S8, the abnormal note information 142 in which the content of the abnormality factor information 144 is "serial number-disagreement" is added to the abnormal note list 141 based on a result of the first recognition processing.

Here, a matter deemed to be a factor in causing an abnormality of "serial number-disagreement" will be described. When the third recognition processing is performed, a banknote is transported from the depositing unit 16 to the recognition unit 12 via the fifth transport path 415 and the upper-side path 4111. Since the direction in which the fifth transport path 415 extends differs from the direction in which the upper-side path 4111 extends, the banknote warps when transported from the fifth transport path 415 to the upper-side path 4111. At this time, the banknote warps in the opposite direction to the direction when the first recognition processing is performed. That is, the direction in which the banknote warps when transported from the fifth transport path 415 extending in the third direction to the upper-side path 4111 extending in the first direction differs from the direction in which the banknote warps when transported from the rear reversing path 4113 extending in the second direction to the upper-side path 4111 extending in the first direction. Thus, in a case where the warpage direction of a banknote varies between when the first recognition processing is performed and when the third recognition processing is performed, the distance from the position of the serial number to the recognition unit 12 also varies. Consequently, a recognition result of a serial number may vary between the first recognition processing and the third recognition processing.

Note that, the control unit 15 may also determine that an abnormality of "serial number-disagreement" does not occur in a case where a serial number of a banknote recognized in the first recognition processing disagrees with a serial number in the banknote information 242B corresponding to the banknote by a number of digits that is equal to or less than a number of digits set in advance. Even in a case where a serial number of a banknote recognized in the first recognition processing disagrees with a serial number in the banknote information 242B corresponding to the banknote, the control unit 15 may determine that an abnormality of "serial number-disagreement" does not occur when the serial number of the banknote recognized in the first recognition processing agrees with a serial number in the banknote information 242B corresponding to another banknote. Although the dispensing processing has been described thus far as an example of the discharging processing, the banknote movement is the same in the case of collection processing. For example, operations of the collection processing can be understood by replacing the dispensing amount described above with a collection amount or a number of collected banknotes.

(3. First Storage Processing and Second Storage Processing)

Next, the first storage processing and the second storage processing will be described. The first storage processing of Embodiment 3 and the first storage processing of Embodiments 1 and 2 are common except a difference 3-4 described below. Further, the second storage processing of Embodiment 3 and the second storage processing of Embodiments 1 and 2 are common except differences 3-4 and 3-5 described below.

Difference 3-4: the banknote information 242B corresponding to a stored banknote is added to the serial number list 241B in step S20, and Difference 3-5: the content of the condition determination processing in step S12.

The difference 3-5 will be described. In the condition determination processing in step S12, the control unit 15 determines whether the condition 1-3 described above or a condition 1-4 described below is satisfied.

The condition 1-4 is a condition related to a factor in causing a banknote to be recognized as abnormal in the first recognition processing. The condition 1-4 is a condition that a factor in causing a banknote to be recognized as abnormal is an abnormality of a serial number ("serial number-unreadable" or "serial number-disagreement"). In a case where an abnormality of a banknote is "serial number-unreadable" or "serial number-disagreement", the control unit 15 determines that the storage object banknote is a banknote for which the predetermined condition is satisfied. In a case where an abnormality of a banknote is an abnormality other than "serial number-unreadable" and "serial number-disagreement", the control unit 15 determines that the storage object banknote is a banknote for which the predetermined condition is not satisfied.

(Working Effects of Embodiment 3)

Embodiment 3 described above exhibits the same working effects as those exhibited by Embodiments 1 and 2.

Embodiment 4

Figure 9:
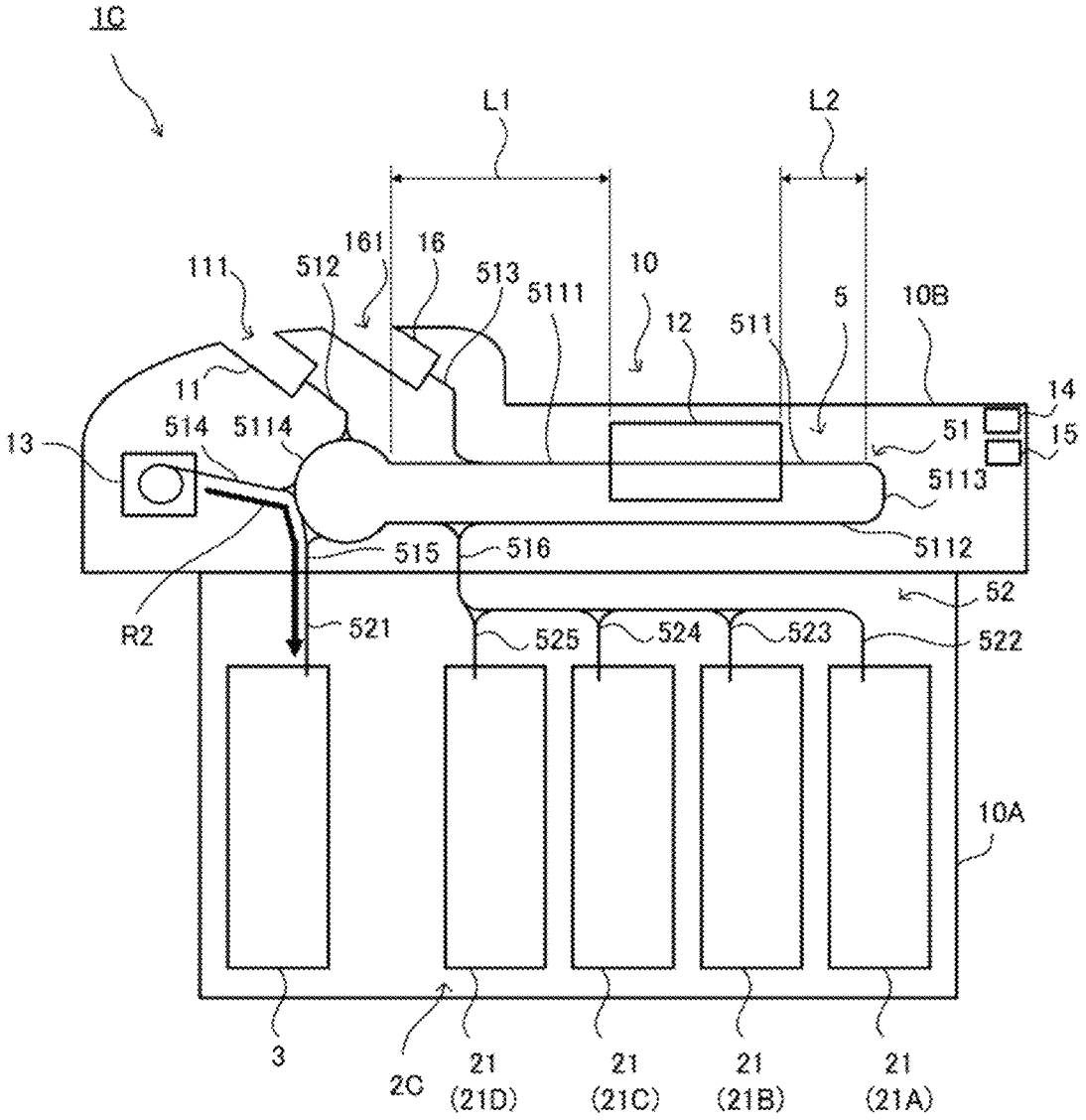
FIG. 9 is a schematic diagram illustrating an overview of an internal configuration of a banknote processing apparatus according to the present disclosure.

Next, Embodiment 4 of the present disclosure will be described. A configuration of a banknote processing apparatus in Embodiment 4 of the present disclosure will be described. FIG. 9 is a block diagram illustrating an overview of an internal configuration of the banknote processing apparatus. Note that, a banknote processing apparatus 1C in Embodiment 4 is an example of the banknote processing apparatus 1 of Embodiment 1. The same configurations as those of the banknote processing apparatuses 1, 1A and 1B of Embodiments 1 to 3 will be denoted by the same reference signs, and descriptions thereof will be simplified or omitted.

The banknote processing apparatus 1C illustrated in FIG. 9 comprises the housing 10 that comprises a lower housing 10A and an upper housing 10B. The lower housing 10A has a structure as a safe. The lower housing 10A is configured such that only authorized people such as a manager are allowed to set a first storage unit 2C to be described later and the second storage unit 3 in the lower housing 10A and to take out the first storage unit 2C and the second storage unit 3 from the lower housing 10A by opening a door. The upper housing 10B is disposed on the lower housing 10A.

The banknote processing apparatus 1C further comprises the depositing unit 16, the dispensing unit 11, the recognition unit 12, the first storage unit 2C, the second storage unit 3, the temporary storage unit 13, the transport unit 5, the memory unit 14, and the control unit 15. The depositing unit 16, the dispensing unit 11, the recognition unit 12, the temporary storage unit 13, the memory unit 14, and the control unit 15 are provided in the upper housing 10B. The first storage unit 2C and the second storage unit 3 are provided in the lower housing 10A. The transport unit 5 is configured so as to be capable of transporting a banknote between the lower housing 10A and the upper housing 10B. At least one of the memory unit 14 and the control unit 15 may also be provided in the lower housing 10A.

The first storage unit 2C comprises a plurality of recycling storage apparatuses 21. In the present Embodiment 4, the first storage unit 2C comprises four recycling storage apparatuses 21. Note that, hereinafter, the four recycling storage apparatuses 21 may be referred to as "first recycling storage apparatus 21A", "second recycling storage apparatus 21B", "third recycling storage apparatus 21C", and "fourth recycling storage apparatus 21D", respectively. The denominations of banknotes that are stored in the first recycling storage apparatus 21A to the fourth recycling storage apparatus 21D are set differently in advance. Note that, at least one of the first recycling storage apparatus 21A to the fourth recycling storage apparatus 21D may be formed of a tape-type storing unit that uses a strip-shaped tape attached to the outer peripheral surface of a drum to wind a banknote on the drum together with the tape. Further, five or more recycling storage apparatuses 21 may form the first storage unit 2C, and the denominations of banknotes that are stored in the respective recycling storage apparatuses 21 preferably differ from each other.

The transport unit 5 comprises an upper-side transport unit 51 and a lower-side transport unit 52. The upper-side transport unit 51 is provided in the upper housing 10B. The lower-side transport unit 52 is provided in the lower housing 10A.

The upper-side transport unit 51 comprises a first transport path 511, a second transport path 512, a third transport path 513, a fourth transport path 514, a fifth transport path 515, and a sixth transport path 516.

The first transport path 511 is formed in a loop shape. The first transport path 511 comprises an upper-side path 5111 extending longitudinally, a lower-side path 5112 extending longitudinally below the upper-side path 5111, a rear reversing path 5113 connecting the upper-side path 5111 and the lower-side path 5112 on the rear side, and a front reversing path 5114 connecting the upper-side path 5111 and the lower-side path 5112 on the front side. The upper-side path 5111 is provided with the recognition unit 12. The recognition unit 12 is provided at a position at which a distance L1 of a part (straight part) of the upper-side path 5111, where the part extends in the horizontal direction from the front end of the recognition unit 12 to the temporary storage unit 13, is longer than a distance L2 of a part (straight part) of the upper-side path 5111, where the part extends in the horizontal direction from the rear end of the recognition unit 12 to the rear reversing path 5113.

The second transport path 512 connects the dispensing unit 11 and a position of the upper-side path 5111, where the position is on the front side of the recognition unit 12. A connection part between the second transport path 512 and the upper-side path 5111 is provided with a first diverter mechanism.

The third transport path 513 connects the depositing unit 16 and a position of the upper-side path 5111, where the position is on the rear side of the first diverter mechanism. A connection part between the third transport path 513 and the upper-side path 5111 is provided with a second diverter mechanism.

The fourth transport path 514 connects the front reversing path 5114 and the temporary storage unit 13. A connection part between the fourth transport path 514 and the front reversing path 5114 is provided with a third diverter mechanism.

The fifth transport path 515 connects the front reversing path 5114 and the lower-side transport unit 52. The fifth transport path 515 and the lower-side transport unit 52 are connected via a transport path penetrating the lower housing 10A. A connection part between the fifth transport path 515 and the front reversing path 5114 is provided with a fourth diverter mechanism.

The sixth transport path 516 connects the lower-side path 5112 and the lower-side transport unit 52. The sixth transport path 516 and the lower-side transport unit 52 are connected via a transport path penetrating the lower housing 10A. A connection part between the sixth transport path 516 and the lower-side path 5112 is provided with a fifth diverter mechanism.

The lower-side transport unit 52 comprises a seventh transport path 521, an eighth transport path 522, a ninth transport path 523, a tenth transport path 524, and an eleventh transport path 525.

The seventh transport path 521 connects the fifth transport path 515 and the second storage unit 3.

The eighth transport path 522 connects the sixth transport path 516 and the first recycling storage apparatus 21A.

The ninth transport path 523 connects the eighth transport path 522 and the second recycling storage apparatus 21B. A connection part between the ninth transport path 523 and the eighth transport path 522 is provided with a sixth diverter mechanism.

The tenth transport path 524 connects the third recycling storage apparatus 21C and a position of the eighth transport path 522, where the position is on the front side of the sixth diverter mechanism. A connection part between the tenth transport path 524 and the eighth transport path 522 is provided with a seventh diverter mechanism.

The eleventh transport path 525 connects the fourth recycling storage apparatus 21D and a position of the eighth transport path 522, where the position is on the front side of the seventh diverter mechanism. A connection part between the eleventh transport path 525 and the eighth transport path 522 is provided with an eighth diverter mechanism.

The first transport path 511 to the sixth transport path 516 and the seventh transport path 521 to the eleventh transport path 525 are each formed of a combination of a roller, a belt wound on the roller, a motor that drives the roller, a sidewall, and the like. Tracking sensors that detect the passage of a banknote are provided at predetermined positions of the first transport path 511 to the sixth transport path 516 and the seventh transport path 521 to the eleventh transport path 525. The control unit 15 detects the position of a banknote based on detection signals from the tracking sensors, and controls the first diverter mechanism and the eighth diverter mechanisms, thereby transporting the banknote to a predetermined configuration.

The memory unit 14 stores the serial number list 241B as illustrated in FIG. 8 and the abnormal note list 141A illustrated in FIG. 6.

(Operations of Banknote Processing Apparatus)

Next, operations of the banknote processing apparatus 1C will be described. In Embodiment 4, depositing processing, dispensing processing as an example of the discharging processing, first storage processing, and second storage processing that are the same as those in Embodiment 3 are performed. Here, descriptions will be given mainly of differences of each processing between Embodiments 3 and 4.

(1. Depositing Processing)

First, the depositing processing will be described. When the control unit 15 realizes a banknote depositing instruction by an operator, the control unit 15 causes one banknote stacked in the depositing unit 16 to be transported to the recognition unit 12 via the third transport path 513 and the upper-side path 5111, and the recognition unit 12 performs the third recognition processing.

The control unit 15 causes the banknote determined as a normal note based on a result of the third recognition processing to pass through at least the upper-side path 5111, the rear reversing path 5113, the lower-side path 5112, the sixth transport path 516, and the eighth transport path 522 and to be stored in the recycling storage apparatus 21 (one of the first recycling storage apparatus 21A to the fourth recycling storage apparatus 21D (the first storage unit 2C)) corresponding to the banknote. The control unit 15 adds the banknote information 242B of the banknote recognized as normal based on the result of the third recognition processing to the serial number list 241B.

The control unit 15, on the other hand, causes the banknote determined as abnormal based on a result of the third recognition processing to pass through the upper-side path 5111, the rear reversing path 5113, the lower-side path 5112, the front reversing path 5114, and the second transport path 512, and to be dispensed from the dispensing unit 11. The control unit 15 repeats the processing to cause a banknote to be stored in the first storage unit 2C or the second storage unit 3 based on a result of the third recognition processing until there is no banknote in the depositing unit 16. Note that, the control unit 15 may cause a banknote determined as normal in the third recognition processing to be stored in the temporary storage unit 13. After there is no banknote in the depositing unit 16 and a depositing amount is accepted, the control unit 15 causes a banknote stored in the temporary storage unit 13 to be stored in the recycling storage apparatus 21 (one of the first recycling storage apparatus 21A to the fourth recycling storage apparatus 21D (the first storage unit 2C)) corresponding to the banknote.

(2. Dispensing Processing)

Next, the dispensing processing will be described. The control unit 15 performs the processing in steps S1 to S8 illustrated in FIG. 4. In step S2, the control unit 15 causes a banknote to be fed out from the recycling storage apparatus 21 (one of the first recycling storage apparatus 21A to the fourth recycling storage apparatus 21D (the first storage unit 2C)) corresponding to the banknote to be dispensed. In step S3, the control unit 15 causes the banknote to be transported to the recognition unit 12 via at least the eighth transport path 522, the sixth transport path 516, the lower-side path 5112, the rear reversing path 5113, and the upper-side path 5111, and causes the recognition unit 12 to perform the first recognition processing (step S3).

In step S5, the control unit 15 causes the banknote recognized as normal in the first recognition processing to pass through the upper-side path 5111, the front reversing path 5114, and the second transport path 512 and to be dispensed from the dispensing unit 11. In step S7, the control unit 15 causes the banknote recognized as abnormal in the first recognition processing to pass through the upper-side path 5111, the front reversing path 5114, and the fourth transport path 514 and to be stored in the temporary storage unit 13.

(3. Storage Processing)

Next, the storage processing will be described. The control unit 15 performs the processing in steps S11 to S20 illustrated in FIG. 5 as the first storage processing or the second storage processing.

In the first storage processing, the control unit 15 determines in the condition determination processing in step S12 whether the conditions 2-1 and 2-2 are satisfied. The control unit 15 may determine only one of the conditions 2-1 and 2-2 or both the conditions.

The condition 2-1 is a condition related to a number of banknotes stored in the first storage unit 2C. For example, the condition 2-1 is a condition that the number of banknotes stored in the recycling storage apparatus 21 in which a storage object banknote has been stored is equal to or less than the first threshold value at the time when the dispensing processing ends.

The control unit 15 realizes the recycling storage apparatus 21 (one of the first recycling storage apparatus 21A to the fourth recycling storage apparatus 21D (the first storage unit 2C)) in which the storage object banknote has been stored, the control unit 15 determines that the predetermined condition is satisfied when the number of banknotes stored in the realized recycling storage apparatus 21 at the time when the dispensing processing ends is equal to or less than the first threshold value, and the control unit 15 determines that the predetermined condition is not satisfied when the number of banknotes stored in the realized recycling storage apparatus 21 at the time when the dispensing processing ends exceeds the first threshold value.

The condition 2-2 is a condition related to the number of banknotes stored in the temporary storage unit 13. For example, the condition 2-2 is a condition that, of banknotes stored in the temporary storage unit 13 at the time when the dispensing processing ends, the total number of banknotes having been stored in the recycling storage apparatus 21 that is the same recycling storage apparatus 21 in which a storage object banknote has been stored is equal to or less than the second threshold value.

The control unit 15 realizes the recycling storage apparatus 21 (one of the first recycling storage apparatus 21A to the fourth recycling storage apparatus 21D (the first storage unit 2C)) in which the storage object banknote has been stored, the control unit 15 determines that the predetermined condition is satisfied when, of banknotes stored in the temporary storage unit 13 at the time when the dispensing processing ends, the total number of banknotes having been stored in the realized recycling storage apparatus 21 is equal to or less than the second threshold value, and the control unit 15 determines that the predetermined condition is not satisfied when, of the banknotes stored in the temporary storage unit 13 at the time when the dispensing processing ends, the total number of banknotes having been stored in the realized recycling storage apparatus 21 exceeds the second threshold value.

In the first storage processing, in a case where it has been determined in step S18 that a banknote remains in the temporary storage unit 13, the control unit 15 performs the processing in step S12.

In the first storage processing and the second storage processing, in step S15, the control unit 15 causes the banknote to be transported to the recognition unit 12 via the fourth transport path 514, the front reversing path 5114, and the upper-side path 5111, and causes the recognition unit 12 to perform the second recognition processing. In step S17, the control unit 15 causes a banknote in a case where it has been determined that the predetermined condition is satisfied or a banknote recognized as abnormal in the second recognition processing to pass through the upper-side path 5111, the rear reversing path 5113, the lower-side path 5112, the front reversing path 5114, and the fourth transport path 514 and to be stored in the temporary storage unit 13. In step S20, the control unit 15 causes the banknote recognized as abnormal in the second recognition processing to pass through at least the upper-side path 5111, the rear reversing path 5113, the lower-side path 5112, the sixth transport path 516, and the eighth transport path 522 and to be stored in the recycling storage apparatus 21 (one of the first recycling storage apparatus 21A to the fourth recycling storage apparatus 21D (the first storage unit 2C)) corresponding to banknote.

(Working Effects of Embodiment 4)

Embodiment 4 described above exhibits the same working effects as those exhibited by Embodiments 1 to 3.

VARIATIONS OF EMBODIMENTS

It goes without saying that the present disclosure is not limited to those indicated in the embodiments described thus far, and various modifications can be made without departing from the spirit of the present disclosure. The embodiments described above and variations indicated below, in so far as applicable, may be combined in any way.

Variation 1

Figure 10:
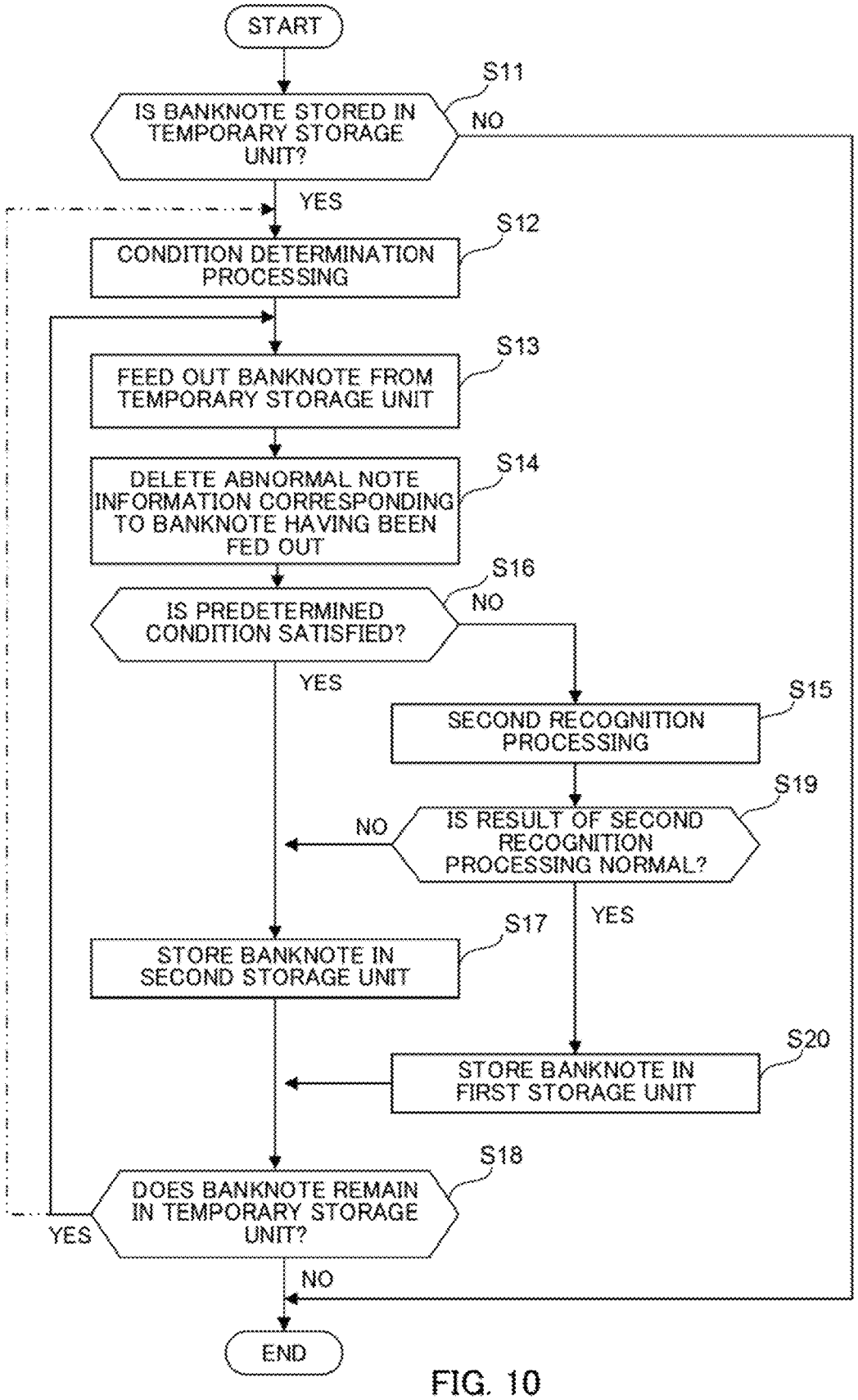
FIG. 10 is a flowchart illustrating storage processing according to the present disclosure.

The storage processing in Embodiments 1 to 4 may also be performed based on a flowchart illustrated in FIG. 10. After the processing in steps S11 to S14, the control unit 15 determines whether it has been determined in the condition determination processing that the predetermined condition is satisfied (step S16). In a case where it has been determined that the predetermined condition is not satisfied (step S16: NO), the control unit 15 causes a banknote to be transported to the recognition unit 12 and causes the recognition unit 12 to perform the second recognition processing (step S15). In step S19 subsequent thereto, the control unit 15 causes a banknote, whose result of the second recognition processing has been determined as normal, to be stored in the first storage unit 2, 2A or 2C (step S20). The control unit 15 causes a banknote, whose result of the second recognition processing has been determined as abnormal in step S19, to be stored in the second storage unit 3 (step S17), and performs the processing in step S18.

In a case where it has been determined that the predetermined condition is satisfied (step S16: YES), the control unit 15 does not perform the second recognition processing on the banknote, but causes the banknote to be stored in the second storage unit 3 (step S17). Here, since it has been determined that the predetermined condition is satisfied, the following two transport routes of the banknote are conceivable in a case where the second recognition processing is not performed but the banknote is stored in the second storage unit 3.

A first transport route is a route that causes a banknote to pass through the recognition unit 12 in the same manner as in a case where it has been determined that the predetermined condition is not satisfied. In this case, when the banknote passes through the recognition unit 12 after it has been determined that the predetermined condition is not satisfied, the control unit 15 does not allow the recognition unit 12 to perform the second recognition processing.

A second transport route is a route that does not allow a banknote to pass through the recognition unit 12. For example, in the banknote processing apparatus 1C of Embodiment 4, the control unit 15 causes a banknote to pass through the second transport route formed of the fourth transport path 514, the front reversing path 5114, the fifth transport path 515, and the seventh transport path 521 and to be stored in the second storage unit 3 as indicated by an arrow R2. Further, in the banknote processing apparatuses 1, 1A and 1B of Embodiments 1 to 3, a front reversing path 4114 as indicated by a two-dot chain line in FIG. 1 and FIG. 7 may be further provided, and the control unit 15 may cause a banknote to pass through the second transport route formed of the upper-side path 4111, the front reversing path 4114, and the lower-side path 4112 and to be stored in the second storage unit 3 as indicated by the arrow R2.

Variation 2

Figure 11:
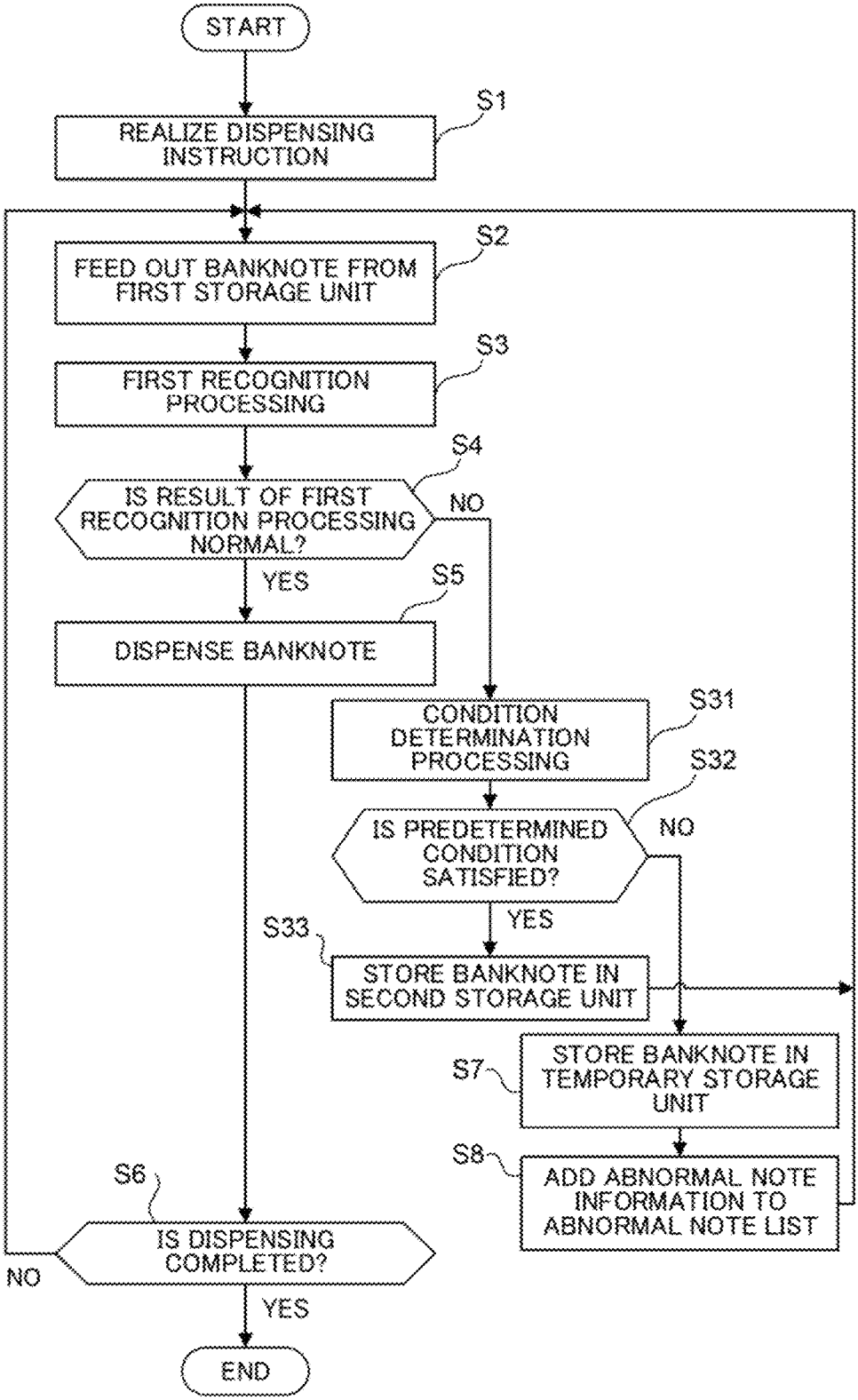
FIG. 11 is a flowchart illustrating dispensing processing according to the present disclosure.
Figure 12:
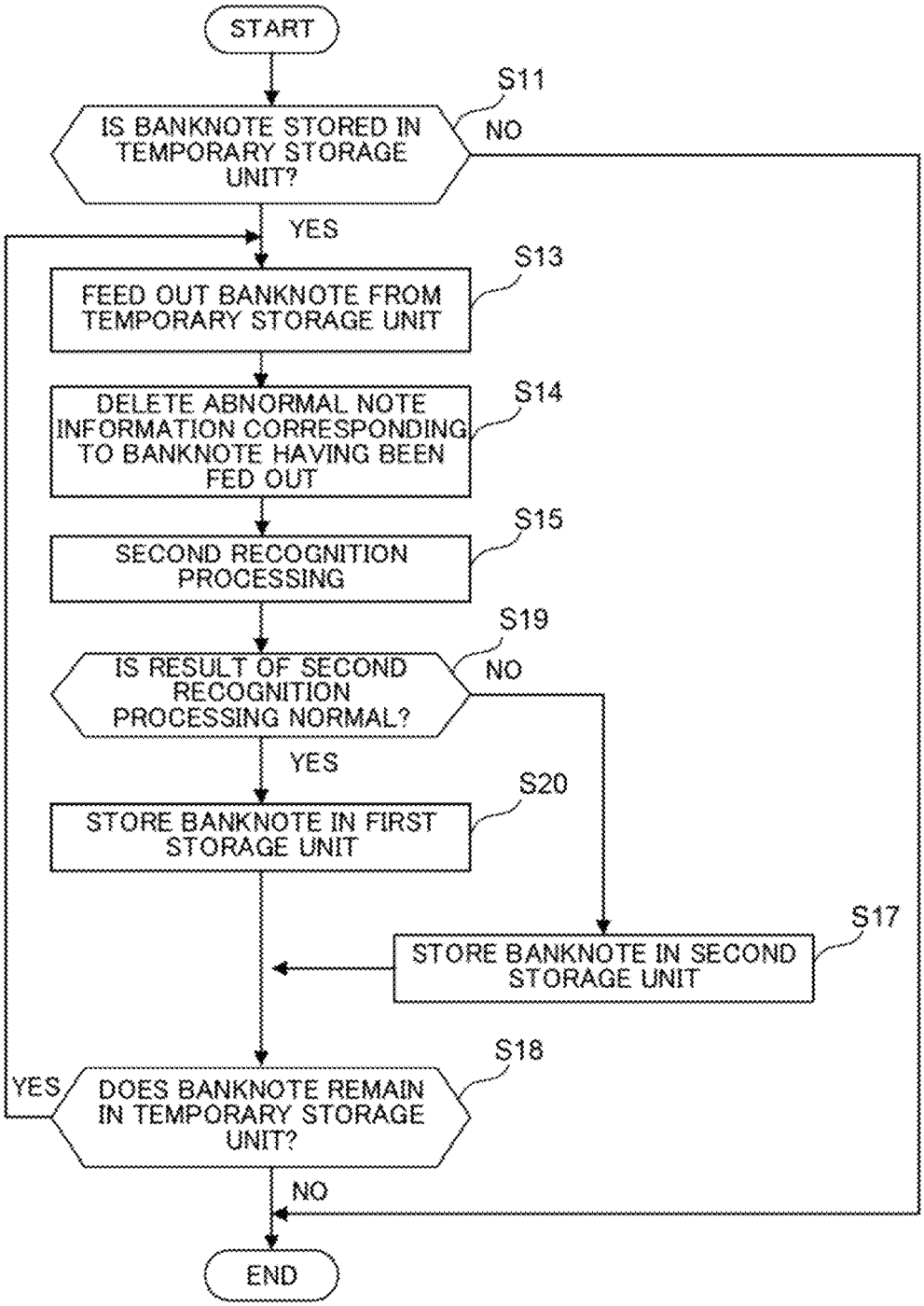
FIG. 12 is a flowchart illustrating storage processing according to the present disclosure.

In Embodiments 1 to 4, dispensing processing illustrated in FIG. 11 and storage processing illustrated in FIG. 12 may also be performed.

First, the dispensing processing will be described. As illustrated in FIG. 11, the control unit 15 performs the processing in steps S1 to S4. The control unit 15 causes a banknote determined as normal in step S4 to be dispensed from the dispensing unit 11 (step S5), and performs the processing in step S6. The processing up to this point is the same as the dispensing processing of Embodiments 1 to 4.

The control unit 15 performs the condition determination processing on a banknote determined as abnormal in step S4 (step S31).

In the condition determination processing, the control unit 15 determines whether a predetermined condition is satisfied. As the predetermined condition, it is possible to exemplify a condition 5-1 and a condition 5-2 described below. In the condition determination processing, the control unit 15 may determine only one of the conditions 5-1 and 5-2 or both the conditions. In the condition determination processing, the control unit 15 may use both the conditions 5-1 and 5-2 as determination objects, determine that the predetermined condition is satisfied in a case where one of the conditions of the determination objects is satisfied, and determine that the predetermined condition is not satisfied in a case where all the conditions of the determination objects are not satisfied.

The condition 5-1 is a condition related to a number of banknotes stored in the first storage units 2, 2A and 2C. For example, the condition 5-1 is a condition that the number of banknotes stored in the first storage units 2, 2A and 2C at a time when the dispensing processing starts or immediately before a storage object banknote is fed out is equal to or less than the first threshold value. In a case where the number of banknotes stored in the first storage units 2, 2A and 2C is equal to or less than the first threshold value, the control unit 15 determines that the predetermined condition is satisfied. In a case where the number of banknotes stored in the first storage units 2, 2A and 2C exceeds the first threshold value, the control unit 15 determines that the predetermined condition is not satisfied.

Here, in a case where the banknote processing apparatus 1 of Embodiment 1 is used, the condition 5-1 is a condition that a number of banknotes stored in one recycling storage apparatus 21 is equal to or less than the first threshold value. When the banknote processing apparatuses 1A, 1B and 1C of Embodiments 2 to 4 are used, the condition 5-1 may be a condition that, of a plurality of recycling storage apparatuses 21, a number of banknotes stored in the recycling storage apparatus 21 in which a storage object banknote has been stored is equal to or less than the first threshold value, or may be a condition that a total number of banknotes in the plurality of recycling storage apparatuses 21 is equal to or less than the first threshold value.

The condition 5-2 is a condition related to a factor in causing a banknote to be recognized as abnormal in the first recognition processing. For example, the condition 5-2 is a condition that the factor in causing a banknote to be recognized as abnormal is an abnormality of a serial number. In a case where an abnormality of a banknote is an abnormality of a serial number, the control unit 15 determines that the storage object banknote is a banknote for which the predetermined condition is satisfied. In a case where an abnormality of a banknote is an abnormality other than an abnormality of a serial number, the control unit 15 determines that the storage object banknote is a banknote for which the predetermined condition is not satisfied.

Here, in a case where the banknote processing apparatus 1 of Embodiment 1 is used, an abnormality of a serial number in the condition 5-2 is "serial number-unreadable". In a case where the banknote processing apparatuses 1A, 1B and 1C according to Embodiments 2 to 4 are used, an abnormality of a serial number in the condition 5-2 is "serial number-unreadable" or "serial number-disagreement".

After the processing in step S31, the control unit 15 determines whether it has been determined that the predetermined condition is satisfied for a banknote (step S32). In a case where it has been determined that the predetermined condition is satisfied for the banknote (step S32: YES), the control unit 15 causes the banknote to be stored in the second storage unit 3 (step S33), and performs the processing in step S2.

In a case where it has been determined that the predetermined condition is not satisfied for the banknote (step S32: NO), the control unit 15 causes the banknote to be stored in the temporary storage unit 13 (step S7). The control unit 15 adds the abnormal note information 142 of the banknote recognized as abnormal to the abnormal note list 141 (step S8), and performs the processing in step S2.

Next, the storage processing will be described. As illustrated in FIG. 12, the control unit 15 performs the processing in step S11. In a case where it has been determined that no banknote is stored in the temporary storage unit 13 (step S11: NO), the control unit 15 ends the storage processing. In a case where it has been determined that a banknote is stored in the temporary storage unit 13 (step S11: YES), the control unit 15 performs the processing in steps S13 to S15 in the same manner as in the storage processing of Embodiments 1 to 4.

After the processing in step S15 (the second recognition processing), the control unit 15 determines whether a result of the second recognition processing is normal (step S19). In a case where it has been determined that the result of the second recognition processing is normal (step S19: YES), the control unit 15 causes the banknote to be stored in the first storage unit 2, 2A or 2C (the recycling storage apparatus 21 corresponding to the banknote) (step S20), and performs the processing in step S18. In a case where it has been determined that the result of the second recognition processing is abnormal (step S19: NO), the control unit 15 causes the banknote to be stored in the second storage unit 3 (step S17), and performs the processing in step S18.

Even in Variation 2 described above, it is possible to suppress a decrease in the dispensing efficiency in the same manner as in Embodiments 1 to 4.

Other Variations

In Embodiments 1 to 4 and Variations 1 and 2, the conditions 1-3 and 5-2 related to a factor in causing a banknote to be recognized as abnormal in the first recognition processing may be an abnormality other than an abnormality of a serial number, for example, tearing, soiling, and perforation of a banknote.

In Embodiments 2 to 4 and Variation 1, a condition that a total number of banknotes stored in all recycling storage apparatuses 21 forming the first storage unit 2A or 2C at a time when the dispensing processing or the collection processing ends is equal to or less than the first threshold value may be applied as the condition 2-1. Further, a condition that the number of banknotes stored in the temporary storage unit 13 at the time when the dispensing processing or the collection processing ends is equal to or less than the second threshold value may be applied as the condition 2-2. In these cases, in a case where it has been determined in step S18 that a banknote remains in the temporary storage unit 13, the processing in step S13 is preferably performed as indicated by a solid line in FIG. 5.

As sheets to be processed with the sheet processing apparatus of the present disclosure, coupons and checks may also be applied.

Figure 13:
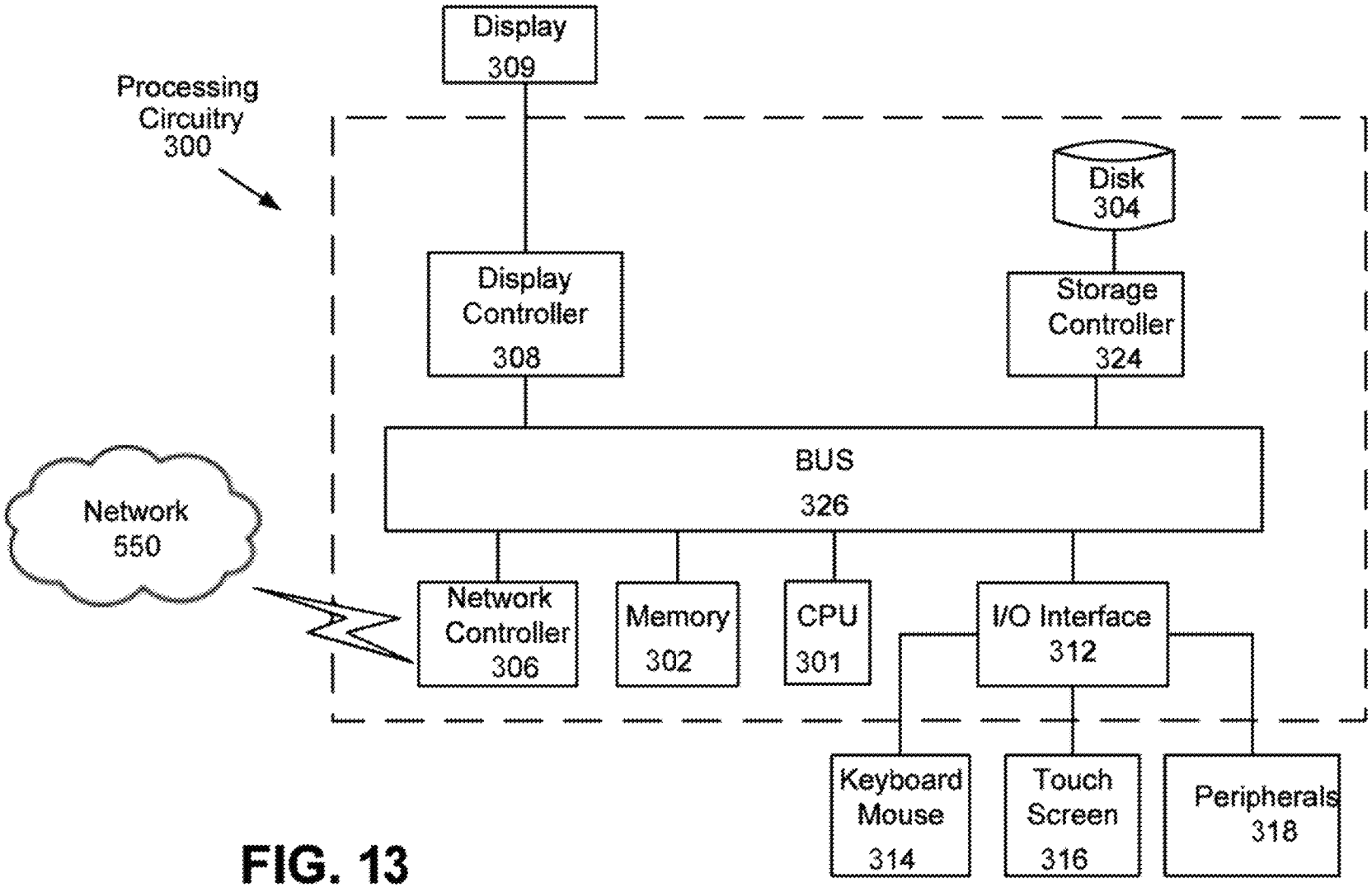
FIG. 13 is a block diagram of processing circuitry that performs computer-based operations in accordance with the present disclosure.

FIG. 13 is a block diagram of processing circuitry that performs computer-based operations in accordance with the present disclosure. FIG. 13 illustrates processing circuitry 300 of control unit 15, which is a component of banknote processing apparatus 1.

Processing circuitry 300 is used to control any computer-based and cloud-based control processes, descriptions or blocks in flowcharts can be understood as representing modules, segments or portions of code which include one or more executable instructions for implementing specific logical functions or steps in the process, and alternate implementations are included within the scope of the exemplary embodiments of the present advancements in which functions can be executed out of order from that shown or discussed, including substantially concurrently or in reverse order, depending upon the functionality involved, as would be understood by those skilled in the art. The functionality of the elements disclosed herein may be implemented using circuitry or processing circuitry which may include general purpose processors, special purpose processors, integrated circuits, ASICs ("Application Specific Integrated Circuits"), conventional circuitry and/or combinations thereof which are configured or programmed to perform the disclosed functionality. Processors are processing circuitry or circuitry as they include transistors and other circuitry therein. The processor may be a programmed processor which executes a program stored in a memory. In the disclosure, the processing circuitry, units, or means are hardware that carry out or are programmed to perform the recited functionality. The hardware may be any hardware disclosed herein or otherwise known which is programmed or configured to carry out the recited functionality.

In FIG. 13, the processing circuitry 300 includes a CPU 301 which performs one or more of the control processes discussed in this disclosure. The process data and instructions may be stored in memory 302. These processes and instructions may also be stored on a storage medium disk 304 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other non-transitory computer readable medium of an information processing device with which the processing circuitry 300 communicates, such as a server or computer. The processes may also be stored in network based storage, cloud-based storage or other mobile accessible storage and executable by processing circuitry 300.

Further, the claimed advancements may be provided as a utility application, background daemon, or component of an operating system, or combination thereof, executing in conjunction with CPU 301 and an operating system such as Microsoft Windows, UNIX, Solaris, LINUX, Apple MAC-OS, Apple iOS and other systems known to those skilled in the art.

The hardware elements in order to achieve the processing circuitry 300 may be realized by various circuitry elements. Further, each of the functions of the above described embodiments may be implemented by circuitry, which includes one or more processing circuits. A processing circuit includes a particularly programmed processor, for example, processor (CPU) 301, as shown in FIG. 13. A processing circuit also includes devices such as an application specific integrated circuit (ASIC) and conventional circuit components arranged to perform the recited functions.

In FIG. 13, the processing circuitry 300 may be a computer or a particular, special-purpose machine. Processing circuitry 300 is programmed to execute processing to control banknote processing apparatus 1.

Alternatively, or additionally, the CPU 301 may be implemented on an FPGA, ASIC, PLD or using discrete logic circuits, as one of ordinary skill in the art would recognize. Further, CPU 301 may be implemented as multiple processors cooperatively working in parallel to perform the instructions of the inventive processes described above.

The processing circuitry 300 in FIG. 13 also includes a network controller 306, such as an Ethernet PRO network interface card, for interfacing with network 550. As can be appreciated, the network 550 can be a public network, such as the Internet, or a private network such as a local area network (LAN) or wide area network (WAN), or any combination thereof and can also include Public Switched Telephone Network (PSTN) or Integrated Services Digital Network (ISDN) sub-networks. The network 550 can also be wired, such as an Ethernet network, universal serial bus (USB) cable, or can be wireless such as a cellular network including EDGE, 3G and 4G wireless cellular systems. The wireless network can also be Wi-Fi, wireless LAN, Bluetooth, or any other wireless form of communication that is known. Additionally, network controller 306 may be compliant with other direct communication standards, such as Bluetooth, a near field communication (NFC), infrared ray or other.

The processing circuitry 300 further includes a display controller 308, such as a graphics card or graphics adaptor for interfacing with display 309, such as a monitor. An I/O interface 312 interfaces with a keyboard and/or mouse 314 as well as a touch screen panel 316 on or separate from display 109. I/O interface 312 also connects to a variety of peripherals 318.

The storage controller 324 connects the storage medium disk 304 with communication bus 326, which may be an ISA, EISA, VESA, PCI, or similar, for interconnecting all of the components of the processing circuitry 300. A description of the general features and functionality of the display 309, keyboard and/or mouse 314, as well as the display controller 308, storage controller 324, network controller 306, and I/O interface 312 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset.

The functions and features described herein may also be executed by various distributed components of a system. For example, one or more processors may execute these system functions, wherein the processors are distributed across multiple components communicating in a network. The distributed components may include one or more client and server machines, which may share processing, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

REFERENCE SIGNS LIST

1, 1A, 1B, 1C Banknote processing apparatus
2, 2A, 2C First storage unit
3 Second storage unit
4, 4A, 4B, 5 Transport unit
10 Housing
10A Lower housing
10B Upper housing
11 Dispensing unit
12 Recognition unit
13 Temporary storage unit
14 Memory unit
15 Control unit
16 Depositing unit
21 Recycling storage apparatus
21A First recycling storage apparatus
21B Second recycling storage apparatus
21C Third recycling storage apparatus
21D Fourth recycling storage apparatus
51 Upper-side transport unit
52 Lower-side transport unit
111 Outlet

141, 141A Abnormal note list
142, 142A Abnormal note information
143 Storage order information
144 Abnormality factor information
145A Feeding source information
161 Inlet
211 Storage housing
212 Stage
213 Storage-transport mechanism
214 Detection unit
215 Sensor
216 Detection plate
217 Light shielding unit
218 Semi-light shielding unit
241B Serial number list
242B Banknote information
243B Storage order information
244B Serial number information
411, 511 First transport path
412, 512 Second transport path
413, 513 Third transport path
414, 514 Fourth transport path
415, 515 Fifth transport path
516 Sixth transport path
521 Seventh transport path
522 Eighth transport path
523 Ninth transport path
524 Tenth transport path
525 Eleventh transport path
4111, 5111 Upper-side path
4112, 5112 Lower-side path
4113, 5113 Rear reversing path
4114, 5114 Front reversing path

The invention claimed is:

1. A sheet processing apparatus, comprising:

a first storage and a second storage that each stores a sheet;

a transport that transports the sheet;

a recognition circuit that performs a first recognition processing to recognize the sheet;

an outlet that discharges the sheet in a case that the sheet is recognized as normal in the first recognition processing;

a temporary storage that stores the sheet in a case that the sheet is recognized as abnormal in the first recognition processing; and processing circuitry that controls the transport and the recognition circuit such that storage control processing is performed, the storage control processing being processing in which the sheet stored in the temporary storage is transported to the first storage unit or to the second storage, wherein the storage control processing comprises:

first processing in which, in a case where a predetermined condition is satisfied, the sheet stored in the temporary storage is transported to the second storage; and second processing in which, in a case where the predetermined condition is not satisfied, the recognition circuit performs a second recognition processing on the sheet stored in the temporary storage, the sheet recognized as normal is transported to the first storage, and the sheet recognized as abnormal is transported to the second storage, the first processing is processing in which the recognition circuit performs the second recognition processing on the sheet for which the predetermined condition is satisfied, and the sheet for which the predetermined condition is satisfied is transported to the second storage regardless of a recognition result of the second recognition processing.

2. The sheet processing apparatus according to claim 1, wherein the predetermined condition is a condition related to a number of sheets stored in the temporary storage.

3. The sheet processing apparatus according to claim 2, wherein the predetermined condition is a condition that the number of sheets stored in the temporary storage is equal to or less than a second threshold value.

4. The sheet processing apparatus according to claim 1, wherein the predetermined condition is a condition related to a factor resulting in the sheet to be recognized as abnormal in the first recognition processing.

5. The sheet processing apparatus according to claim 4, wherein the factor is a serial number-related abnormality in which a serial number attached to the sheet is abnormal.

6. A sheet processing apparatus comprising:

a first storage and a second storage that each stores a sheet;

a transport that transports the sheet;

a recognition circuit that performs a first recognition processing to recognize the sheet:

an outlet that discharges the sheet in a case that the sheet is recognized as normal in the first recognition processing;

a temporary storage that stores the sheet in a case that the sheet is recognized as abnormal in the first recognition processing; and processing circuitry that controls the transport and the recognition circuit such that storage control processing is performed, the storage control processing being processing in which the sheet stored in the temporary storage is transported to the first storage unit or to the second storage, wherein the storage control processing comprises:

first processing in which, in a case where a predetermined condition is satisfied, the sheet stored in the temporary storage is transported to the second storage; and second processing in which, in a case where the predetermined condition is not satisfied, the recognition circuit performs a second recognition processing on the sheet stored in the temporary storage, the sheet recognized as normal is transported to the first storage, and the sheet recognized as abnormal is transported to the second storage, and the predetermined condition is such a condition related to a number of sheets stored in the first storage that the number of sheets stored in the first storage is equal to or less than a first threshold value.

7. The sheet processing apparatus according to claim 6, wherein the predetermined condition is the condition related to the number of sheets stored in the first storage at a time that the storage control processing starts.

8. The sheet processing apparatus according to claim 6, further comprising a detection sensor that detects a sheet storage state in the first storage, wherein the processing circuitry determines the condition related to the number of sheets stored in the first storage based on a detection result of the detection sensor.

9. A sheet processing apparatus, comprising:

a first storage and a second storage that each stores a sheet;

a transport that transports the sheet;

a recognition circuit that recognizes the sheet;

an outlet that discharges the sheet; and processing circuitry that controls the transport and the recognition circuit such that:

the sheet stored in the first storage is transported to the recognition circuit;

the recognition circuit performs first recognition processing on the sheet that has been transported;

the sheet recognized as normal in the first recognition processing is transported to the outlet; and in a case that the sheet is recognized as abnormal in the first recognition processing and a number of sheets stored in the first storage satisfies a predetermined condition, the sheet recognized as abnormal is transported to the second storage.

10. The sheet processing apparatus according to claim 9, wherein the predetermined condition is a condition that the number of sheets stored in the first storage is equal to or less than a first threshold value.

11. The sheet processing apparatus according to claim 9, further comprising a detection sensor that detects a sheet storage state in the first storage, wherein the processing circuitry determines a condition related to the number of sheets stored in the first storage based on a detection result of the detection sensor.

12. The sheet processing apparatus according to claim 9, further comprising a temporary storage, wherein in a case that the sheet is recognized as abnormal in the first recognition processing and the number of sheets stored in the first storage does not satisfy the predetermined condition, the temporary storage stores the sheet recognized as abnormal.

* * * * *